US012662172B2

(12) United States Patent
Schuller et al.

(10) Patent No.: US 12,662,172 B2
(45) Date of Patent: Jun. 23, 2026

(54) LARGE PLATE TILT RAILROAD CAR

(71) Applicant: Gunderson LLC, Portland, OR (US)

(72) Inventors: Daniel Schuller, North Richland Hills, TX (US); Peter L. Jones, Southlake, TX (US); Christof Hettiger, Irving, TX (US)

(73) Assignee: Gunderson LLC, Lake Oswego, OR (US)

( * ) Notice: Subject to any disclaimer, the term of this patent is extended or adjusted under 35 U.S.C. 154(b) by 533 days.

(21) Appl. No.: 18/343,050

(22) Filed: Jun. 28, 2023

(65) Prior Publication Data

US 2023/0339522 A1 Oct. 26, 2023

Related U.S. Application Data

(63) Continuation-in-part of application No. 17/669,836, filed on Feb. 11, 2022, now Pat. No. 12,509,129.

(51) Int. Cl.
*B61D 9/08* (2006.01)
*B61D 9/10* (2006.01)

(52) U.S. Cl.
CPC *B61D 9/08* (2013.01); *B61D 9/10* (2013.01)

(58) Field of Classification Search
CPC ..... E01B 29/00; E01B 29/02; E01B 29/05; E01B 29/17; B61D 9/02; B61D 3/16; B61D 45/002; B61D 15/00; B61D 9/04; B61D 3/04; B61D 3/166; B61D 45/00; B60P 1/165; B60P 3/002; B60P 1/34; B60P 7/10
USPC ..... 105/355, 261.1, 270
See application file for complete search history.

(56) References Cited

U.S. PATENT DOCUMENTS 798,566 A 8/1905 Carroll
7,044,062 B2 5/2006 Forbes

FOREIGN PATENT DOCUMENTS

PL 65609 Y1 * 9/2011 ..... B61D 3/16

OTHER PUBLICATIONS

"GBX Europe—600k EUR Slab Track Car", photos available prior to Feb. 11, 2022.
"JK-CO Speciality Railcar", photos available prior to Feb. 11, 2022.
"NDTF Turnout Transporters / Tilt-bed wagons for transporting", photo available prior to Feb. 11, 2022.
Screen captures from YouTube video clip entitled "Tipping Box Wagon—Thrall Europa", 8 pages, uploaded on Nov. 7, 2011 by user "KRA." Retrieved from Internet at: https://www.youtube.com/watch?v=BRJnDOAKhus.
"Switch Tilter UK-WA6/TSI-UIC, Switch and Crossing Transport Wagon", Kirow Ardelt GmbH, www.kirow.de, 2021.
"Tilting Railcar", photos available prior to Feb. 11, 2022.
(Continued)

*Primary Examiner* — S. Joseph Morano
*Assistant Examiner* — Heaven R Buffington
(74) *Attorney, Agent, or Firm* — Neal, Gerber & Eisenberg LLP

(57) ABSTRACT

A large plate tilt railroad car including a plate support assembly having a plurality of spaced-apart plate supporters including a plurality of plate holders simultaneously movable from loading positions in which one or more large steel plates can be loaded on the railroad car to transit positions in which one or more large steel plates can be transported using the railroad car.

23 Claims, 24 Drawing Sheets

(56) References Cited

OTHER PUBLICATIONS

"Tilting Wagon" , Wagon No. 9378-007-2 in Millerhill to Kingsknowe train for Midcalder Jet; http://www.scot-rail.co.uk/photo/scaled/13965/, Apr. 27, 2013.
"Tilting Wagon Photo", www.networkrailmediacentre.co.uk/resources?SearchString=tilting+wagon, Oct. 29, 2010.
Taylor, Grahame, "'Those tilting wagons' A stage in the Modular S&C project", www.railwaypeople.com, Sep. 19, 2008.

* cited by examiner

LARGE PLATE TILT RAILROAD CAR

PRIORITY

This application is a continuation-in-part of, claims priority to, and the benefit of U.S. patent application Ser. No. 17/669,836, filed Feb. 11, 2022, the entire contents of which is incorporated herein by reference.

BACKGROUND

The railroad industry employs a variety of different railroad cars for transporting different materials. For example, various known railroad cars often carry large steel plates, and are sometimes called "large plate tilt railroad cars." Known large plate tilt railroad cars are relatively heavy, include hydraulic lifting apparatus, and are relatively complicated, expensive, and require frequent maintenance. Since such large plate tilt railroad cars are relatively heavy, the amount of weight that they can carry is somewhat limited due to overall weight restrictions for railroad cars. There is a continuing need to provide large plate tilt railroad cars that can carry large plates of greater weights, and that are less complicated, less expensive, and require less maintenance.

SUMMARY

Various embodiments of the present disclosure provide a large plate tilt railroad car having a plate support assembly. Various embodiments of the present disclosure provide a plate support assembly for a large plate tilt railroad car. In various example embodiments of the present disclosure, the plate support assembly includes a plurality of spaced-apart plate supporters connected to the deck of the railroad car. The plurality of spaced-apart plate supporters respectively include a plurality of plate holders simultaneously movable from: (a) loading positions in which one or more large plates can be loaded onto plate holders of the railroad car to (b) transit positions in which one or more large plates can be transported on the plate holders using the railroad car, and then simultaneously movable back to (a) unloading positions in which one or more large plates can be unloaded from the plate holders of the railroad car. In various embodiments, the loading and unloading positions are the same positions, although they can vary in accordance with the present disclosure. In various embodiments, the large plate tilt railroad car includes plate movement blockers connected to the plate supporters and configured to prevent longitudinal movements of the plates held by the railroad car.

Other objects, features, and advantages of the present disclosure will be apparent from the following detailed disclosure, taken in conjunction with the accompanying sheets of drawings, wherein like reference numerals refer to like parts.

DETAILED DESCRIPTION

Figure 1:
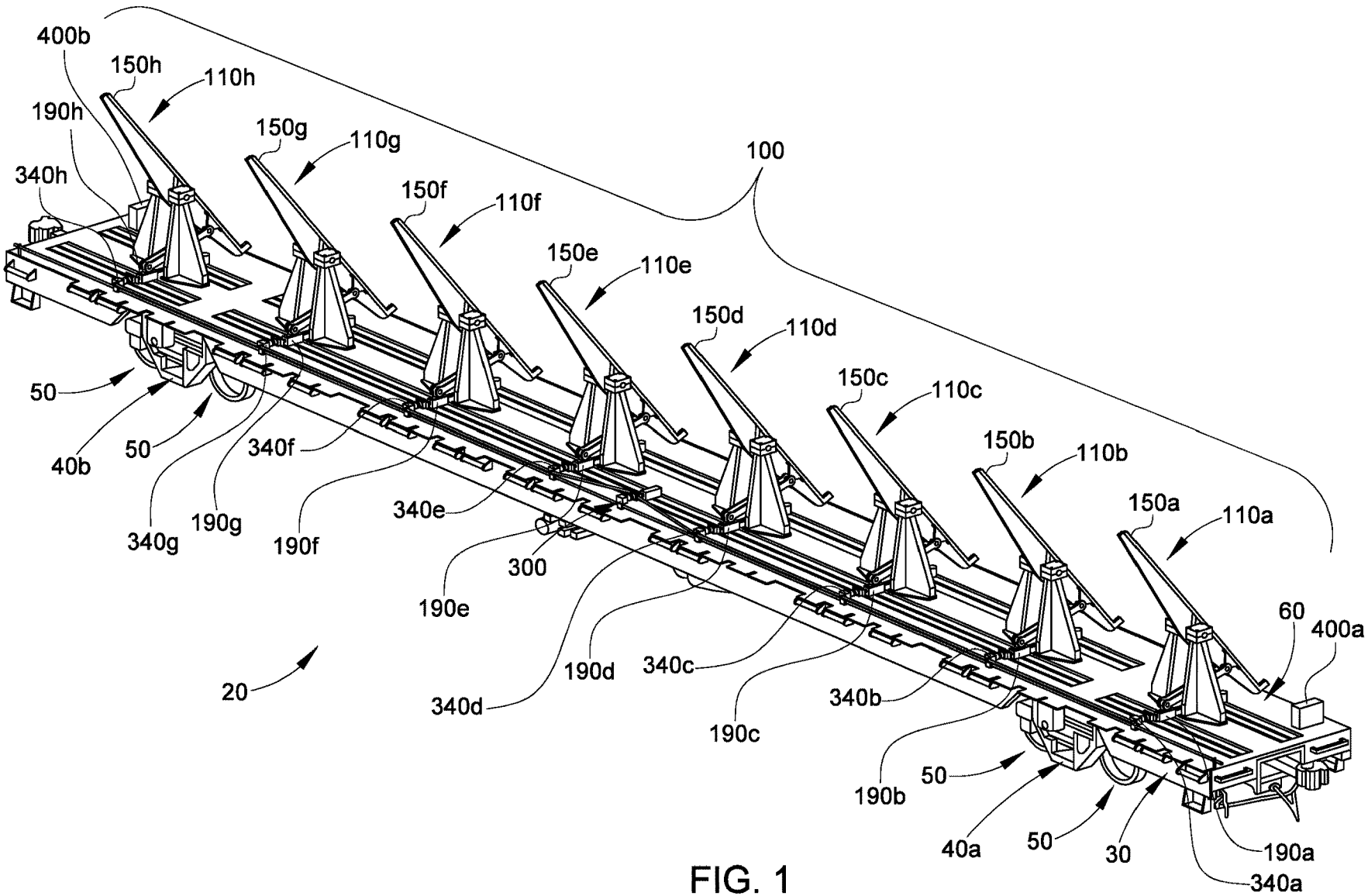
FIG. 1 is a top perspective view of an unloaded large plate tilt railroad car of one example embodiment of the present disclosure.

While the features, devices, and apparatus described herein may be embodied in various forms, the drawings show, and the specification describe certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as coupled, mounted, connected, and the like, are not intended to be limited to direct mounting methods but should be interpreted broadly to include indirect and operably coupled, mounted, connected and like mounting methods. This specification is intended to be taken as a whole and interpreted in accordance with the principles of the present disclosure and as understood by one of ordinary skill in the art.

Various embodiments of the present disclosure provide a large plate tilt railroad car configured to support and transport one or more large plates such as but not limited to large steel plates. Various embodiments of the present disclosure provide a plate support assembly for such large plate tilt railroad car. Various example large steel plates are used herein as a non-limiting example.

Referring now to the drawings, FIGS. 1, 2, 3, 4, 5, 6, 7, 8, 8A, 8B, and 8C illustrate a large plate tilt railroad car 20 of one example embodiment of the present disclosure. This large plate tilt railroad car 20 generally includes: (1) a frame 30; (2) spaced apart trucks 40*a* and 40*b* configured to support the frame 30; (3) a plurality of wheels 50 that support the trucks 40*a* and 40*b*; (4) a deck 60 connected to and supported by the frame 30; and (5) a plate support assembly 100 connected to, extending upwardly from, and supported by the deck 60 (and thus supported by the frame 30, the trucks 40*a* and 40*b*, and the wheels 50). The plate support assembly 100 is generally configured to securely support one or more large plates such as the example large steel plate 25 shown in FIGS. 2, 3, 4, 5, and 6.

The plate support assembly 100 generally includes a plurality of spaced-apart plate supporters 110*a*, 110*b*, 110*c*, 110*d*, 110*e*, 110*f*, 110*g*, and 110*h* connected to the deck 60 and that respectively include a plurality of spaced-apart plate holders 150*a*, 150*b*, 150*c*, 150*d*, 150*e*, 150*f*, 150*g*, and 150*h*. The plurality of plate holders 150*a* to 150*h* are operable to simultaneously move (and to particularly pivot) from: (a) loading/unloading positions (shown in FIGS. 3, 5, and 6) in which one or more large plates (such as steel plate 25) can be loaded onto or unloaded off of the railroad car 20, to (b) transit positions (shown in FIGS. 1, 2, 4, 7, and 8) in which one or more large plates (such as steel plate 25) can be transported using the railroad car 20.

Figure 4:
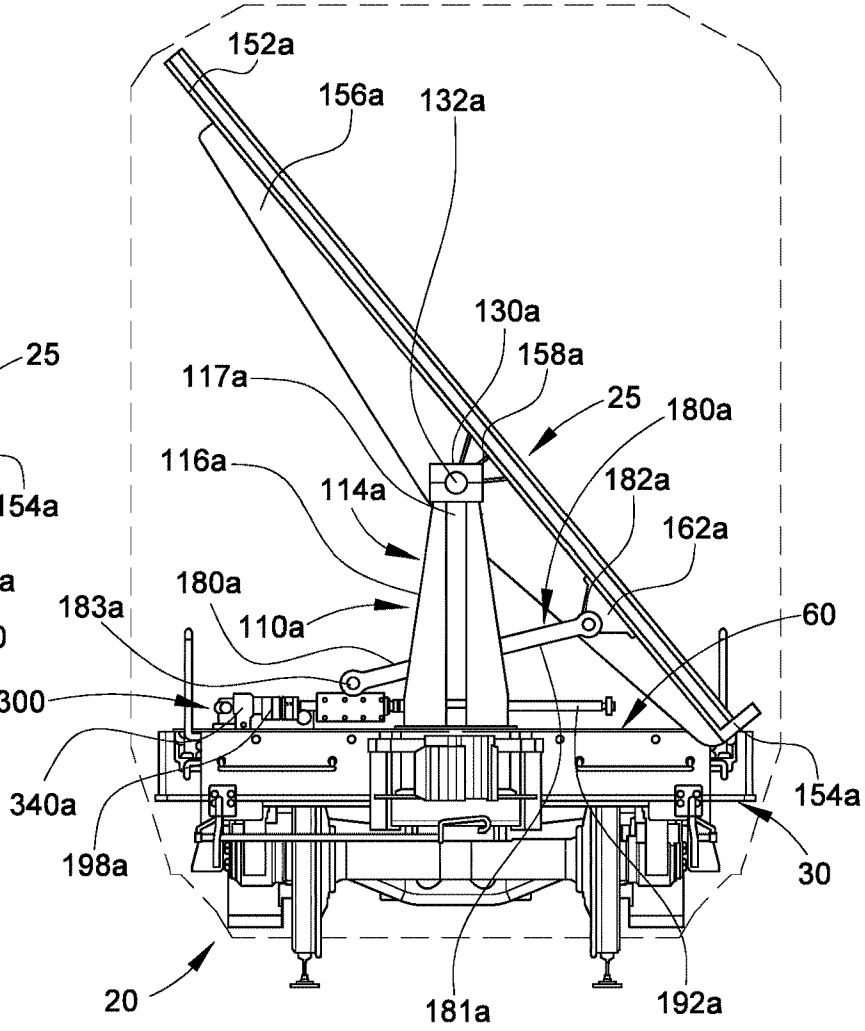
FIG. 4 is an end view of the loaded large plate tilt railroad car of FIG. 1 shown supporting an example large steel plate in the transit position, and with certain components removed to reveal other components.
Figure 3:
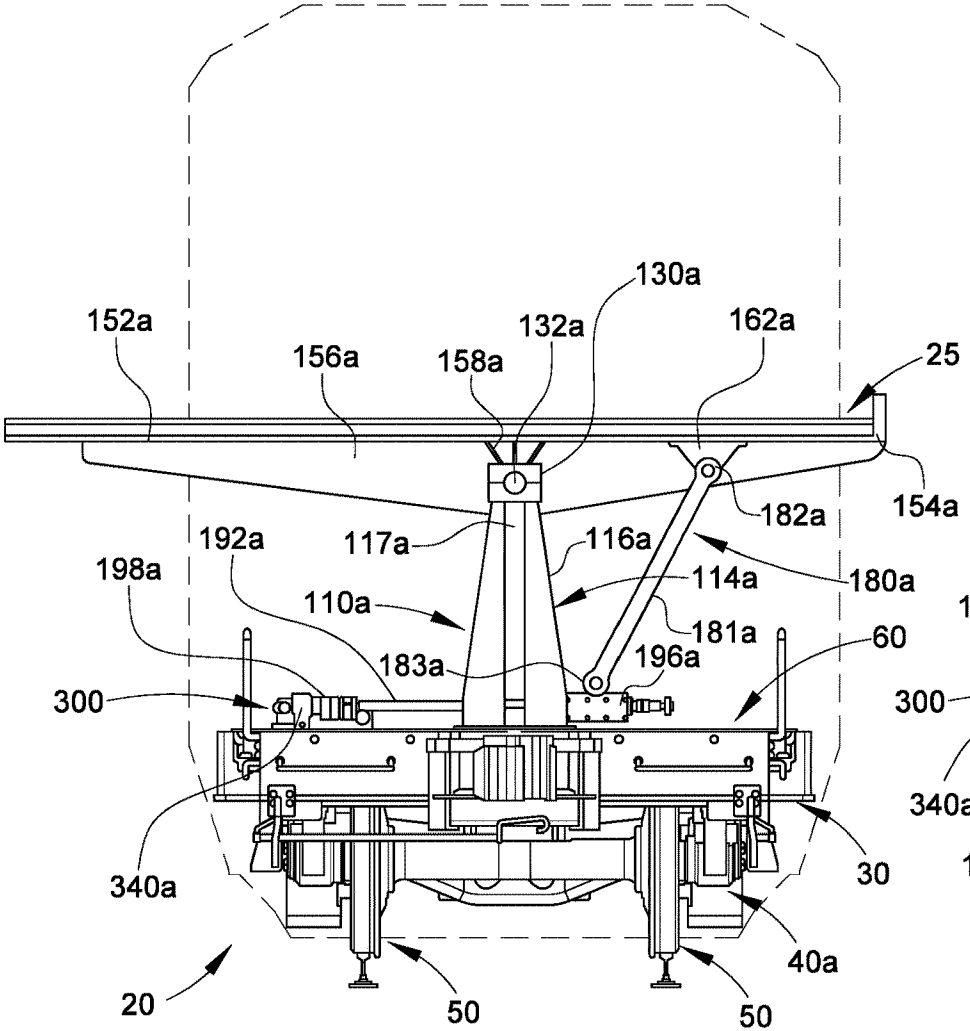
FIG. 3 is an end view of the loaded large plate tilt railroad car of FIG. 1 shown supporting an example large steel plate in a loading/unloading position, and with certain components removed to reveal other components.
Figure 5:
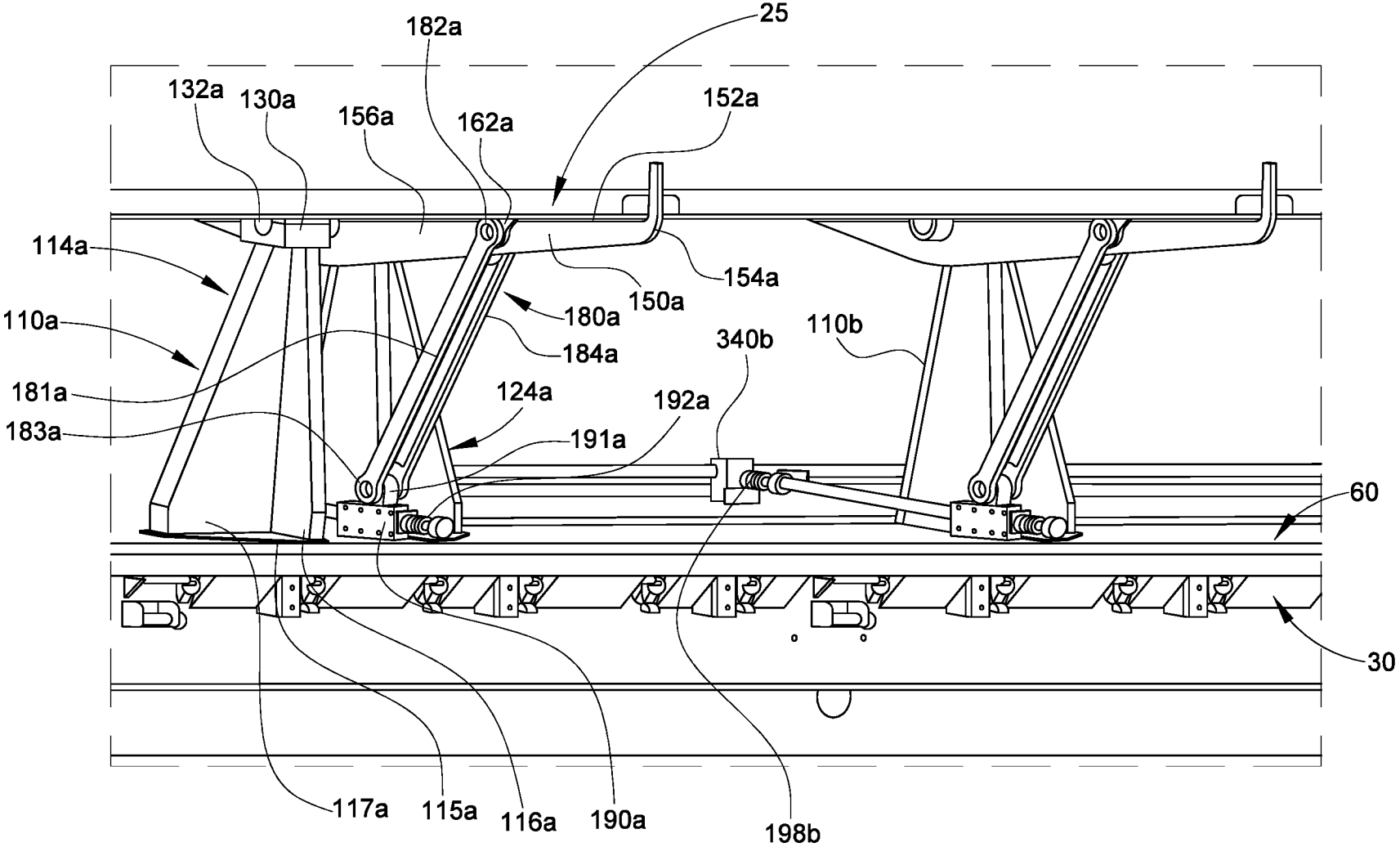
FIG. 5 is a fragmentary perspective view of the loaded large plate tilt railroad car of FIG. 1 shown supporting an example large steel plate in the loading/unloading position, and with certain components removed to reveal other components.
Figure 6:
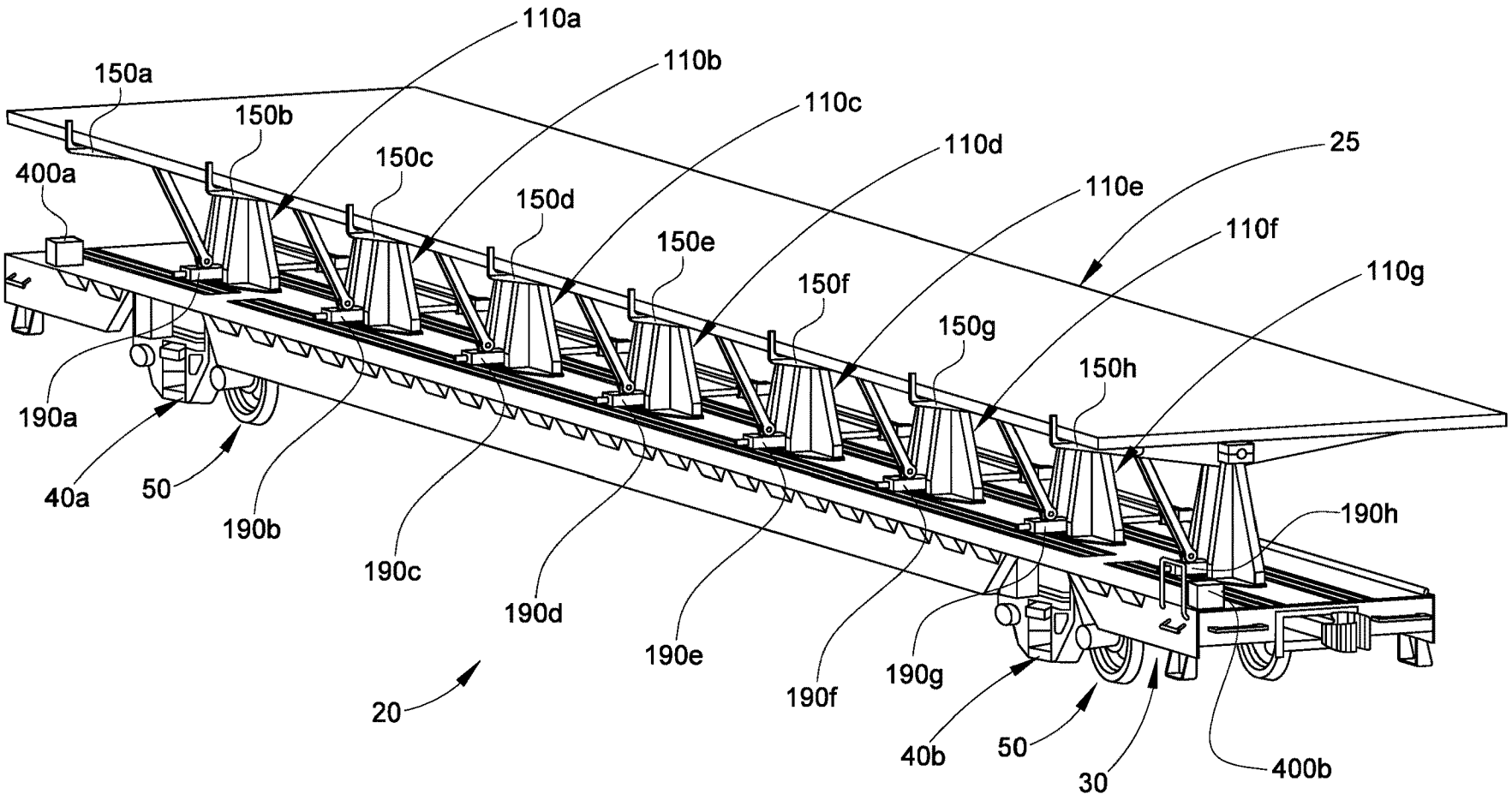
FIG. 6 is a top perspective view of the loaded large plate tilt railroad car of FIG. 1 shown supporting an example large steel plate in the loading/unloading position, and with certain components removed to reveal other components.

It should be appreciated that, as further explained below, the large steel plates are so large that they need to be transported at an angle so that they fit within the maximum outer dimensions allowed for railroad cars and the cargo that they carry (such as the maximum outer dimensions allowed by the AAR). These outer dimensions are generally indicated by the dotted lines in FIGS. 3 and 4. FIG. 3 shows that in the horizontal loading positions, the plurality of plate holders 150*a* to 150*h* and the steel plate 25 extends outside of the allowable maximum outer dimensions indicated by the dotted line. FIG. 4 shows that in the angled transit positions, the plurality of plate holders 150*a* to 150*h* and the steel plate 25 are within the allowable maximum outer dimensions indicated by the dotted line. The plate support assembly 100 and specifically the plurality of spaced-apart plate supporters 110*a* to 110*h*, as further described in detail below, are configured to move the plurality of plate holders 150*a* to 150*h* to the loading/unloading positions for the loading and unloading of the large steel plates on the (stationary) railroad car 20 and to the transit positions for transit of the large steel plates by the railroad car 20.

More specifically, the plate support assembly 100 includes a drive assembly 300 configured to cause each of the plurality of plate holders 150*a* to 150*h* to simultaneously move from the loading/unloading positions to the transit positions, and to simultaneously move from the transit positions to the loading/unloading positions. In this illustrated example embodiment, the drive assembly 300 is actuatable by one or more powered external drive actuators (not shown) removably connectable to the drive assembly 300. In other embodiments, the drive assembly 300 is actuatable by one or more powered drive actuators (not shown) that is/are part of the railroad car 20 such as one or more drive motors mounted to or on the deck 60 of the railroad car 20.

In this illustrated example embodiment, the plate support assembly 100 includes the eight plate supporters 110*a* to 110*h* that are each driven plate supporters and that are each coupled to the drive assembly 300 (as further described below). In this example embodiment, when one or more steel plates (such as plate 25) is/are positioned on the plate holders 150*a* to 150*h* of the plate supporters 110*a* to 110*h*, the plate holders 150*a* to 150*h* of the driven plate supporters 110*a* to 110*h* can all be moved simultaneously. It should also be appreciated that the quantity of plate supporters can vary in accordance with the present disclosure. It should further be appreciated that the positions of the plate supporters can vary in accordance with the present disclosure.

In other embodiments, the plate support assembly can include two different types of plate supporters. Specifically, certain of the plate supporters can be driven plate supporters that are coupled to the drive assembly and one or more of the plate supporters are not driven, are not coupled to the drive assembly, and are thus follower plate supporters (not shown). In this example embodiment, when one or more steel plates are positioned on the plate holders of the plate supporters, the steel plate(s) cause(s) the plate holders of each of the follower plate supporters to follow the movement of the plate holders of the driven plate supporters. It should be appreciated that the follower plate supporters can include or be operable with a suitable securing mechanism (not shown) that secures the plate holders of the follower plate supporter when not in use. It should also be appreciated that the quantity of driven plate supporters and the quantity of follower plate supporters can vary in accordance with the present disclosure. It should further be appreciated that the positions of the driven plate supporters and the positions of the follower plate supporters can vary in accordance with the present disclosure.

Since all of the plate supporters 110*a*, 110*b*, 110*c*, 110*d*, 110*e*, 110*f*, 110*g*, and 110*h* are identical in this example embodiment, the plate supporter 110*a* is used as a primary example to describe these example plate supporters of the present disclosure. The other plate supporters 110*b* to 110*h* are not described in detail herein for brevity.

Figure 7:
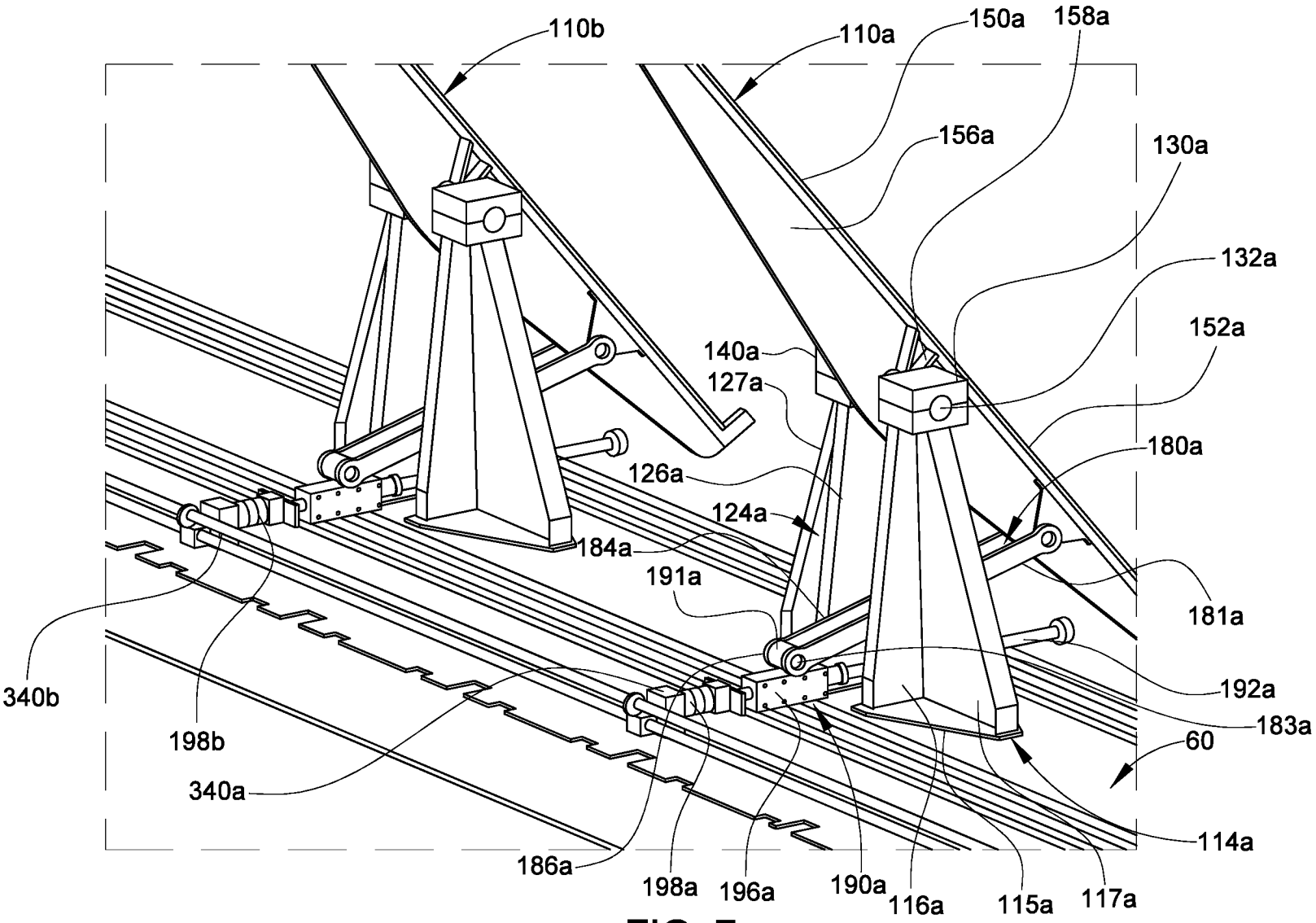
FIG. 7 is an enlarged fragmentary perspective view of the unloaded large plate tilt railroad car of FIG. 1, and with certain components removed to reveal other components.
Figure 8:
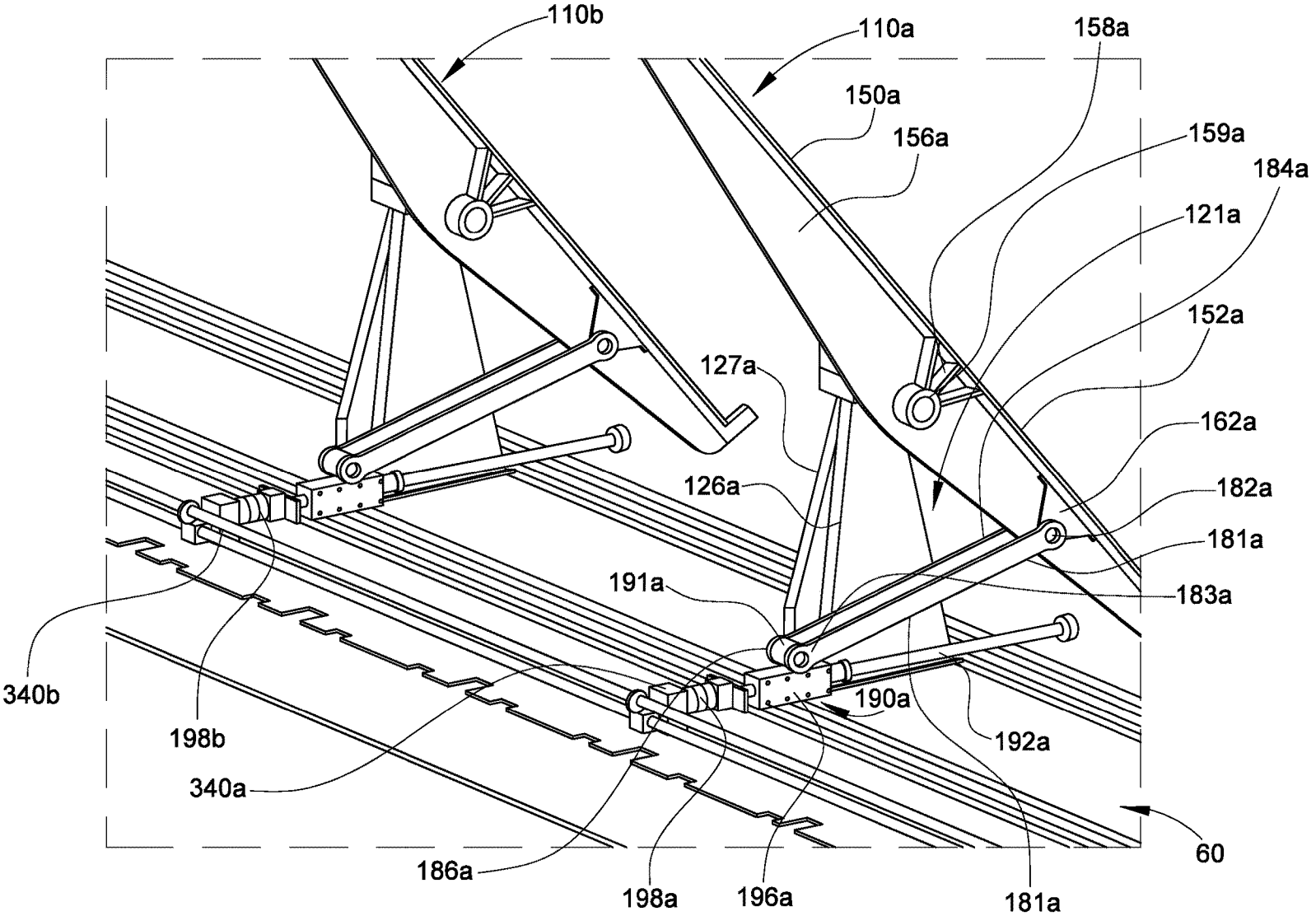
FIG. 8 is an enlarged fragmentary perspective view of the unloaded large plate tilt railroad car of FIG. 1 with certain components removed to reveal other components.
Figure 8A:
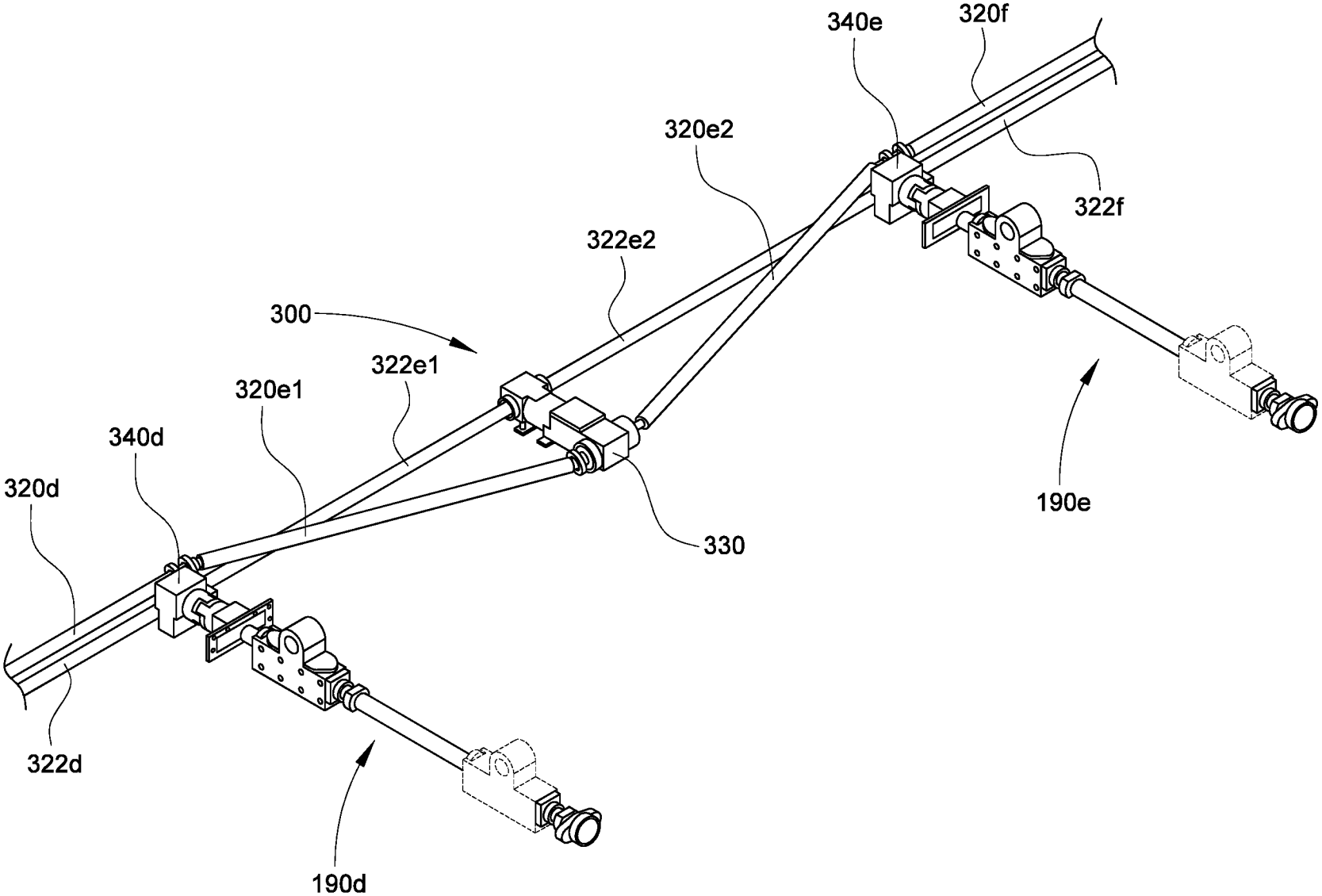
FIG. 8A is an enlarged fragmentary perspective view of part of the drive assembly and two of the jackscrews of the large plate tilt railroad car of FIG. 1.
Figure 8B:
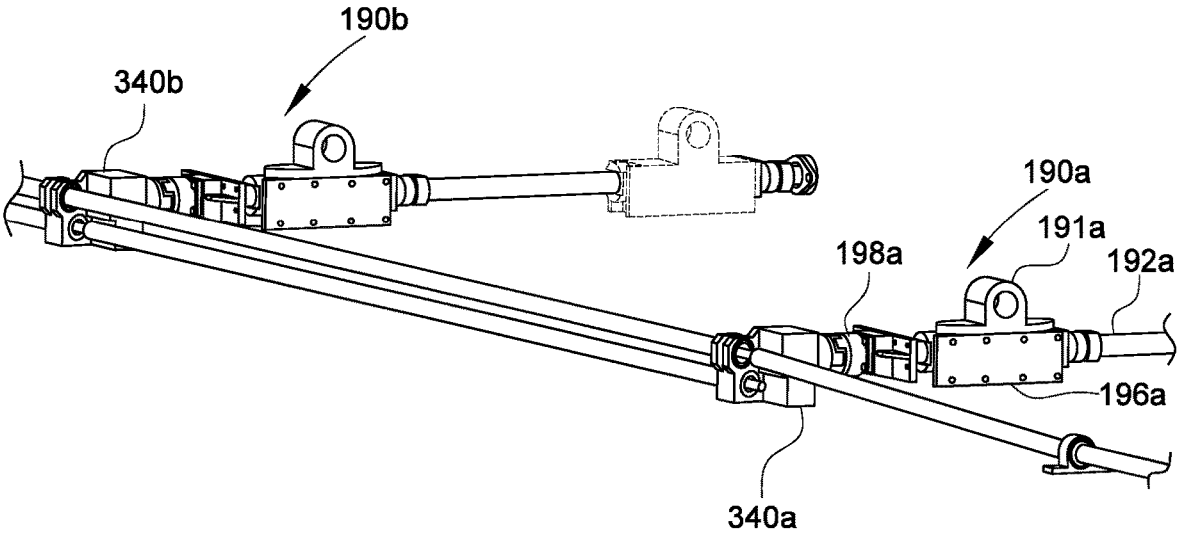
FIG. 8B is an enlarged fragmentary perspective view of part of the drive assembly and two of the jackscrews of the large plate tilt railroad car of FIG. 1.
Figure 8C:
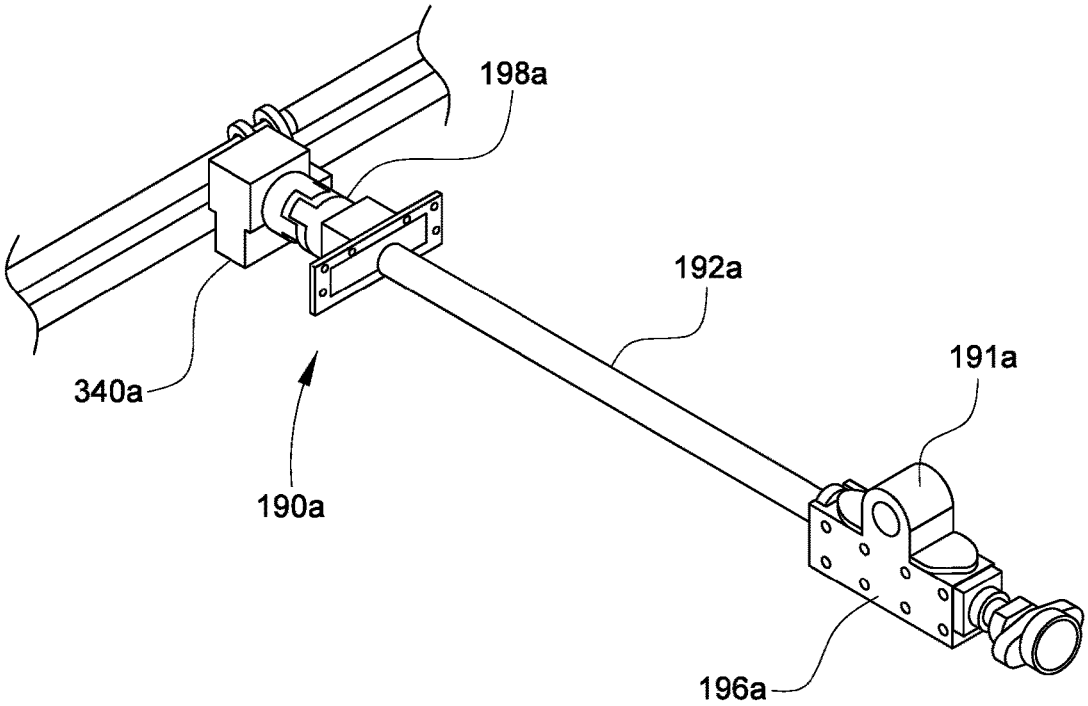
FIG. 8C is an enlarged fragmentary perspective view of part of the drive assembly and one of the jackscrews of the large plate tilt railroad car of FIG. 1.

As best shown in FIGS. 7 and 8, the example plate supporter 110*a* includes: (1) a first leg 114*a* connected to extending upwardly from the deck 60; (2) a second leg 124*a* connected to and extending upwardly from the deck 60; (3) a first pivot pin supporter 130*a* connected to the top of the first leg 114*a*; (4) a second pivot pin supporter 140*a* connected to the top of the second leg 124*a*; (5) the plate holder 150*a* supported by and pivotally connected to the first and second legs 114*a* and 124*a*; (6) a first pivot pin PP1*a* (labeled for ease of reference but not shown) extending through pivot pin receiving bearings 159*a* and 161*a* (labeled for reference but not shown) of the plate holder 150*a* and extending through and supported by the first pivot pin supporter 130*a* and the second pivot pin supporter 140*a*; (7) a jackscrew 190*a* connected to the deck 60; and (8) a plate holder pivot actuator 180*a* including actuators 181*a* and 184*a* pivotally connected at their top ends to the plate holder 150*a* by a second pivot pin PP2*a* (labeled for ease of reference but not shown) and pivotally connected at their bottom ends to the jackscrew 190*a* by a third pivot pin PP3*a* (labeled for ease of reference but not shown).

The first leg 114*a* includes a plate edge holding plate 115*a* positioned on the deck 60 and connected to the deck 60, and two connected leg members 116*a* and 117*a* connected to extending upwardly from the plate edge holding plate 115*a*. Similarly, the second leg 124*a* includes a plate edge holding plate 125*a* (labeled for ease of reference but not shown) positioned on the deck 60 and connected to the deck 60, and two connected leg members 126*a* and 127*a* connected to and extending upwardly from the plate edge holding plate 125*a*. The second leg 124*a* is aligned with and spaced apart from the first leg 114*a*. The space between the first and second legs 114*a* and 124*a* allows the plate holder pivot actuator 180*a* to move between the first and second legs 114*a* and 124*a* when the jackscrew 190*a* is actuated to pivot the plate holder 150*a* as discussed below.

The first pivot pin supporter 130*a* includes a body that defines a pivot pin receipt opening 132*a* configured to receive the pivot pin PP1*a* such that the pivot pin PP1*a* is supported by the first pivot pin supporter 130*a* and the first leg 114*a*. The first pivot pin supporter 130*a* is connected to the top of the first leg 114*a*, and specifically to the tops of the two connected leg members 116*a* and 117*a* of the first leg 114*a*. Likewise, the second pivot pin supporter 140*a* includes a body that defines a pivot pin receipt opening 142*a* (labeled for ease of reference but not shown) configured to receive the pivot pin PP1*a* such that the pivot pin PP1*a* is supported by the first pivot pin supporter 140*a* and the second leg 124*a*. The second first pivot pin supporter 140*a* is connected to the top of the second leg 124*a*, and specifically to the tops of the two connected leg members 126*a* and 127*a* of the second leg 124*a*. The first pivot pin supporter 130*a*, the pivot pin PP1*a*, and the second pivot pin supporter 140*a* (along with the first (central) pivot bracket 158*a* as described below), thus form a joint for pivotally supporting the plate holder 150*a*.

The plate holder 150*a* includes an elongated top arm 152*a* having an elongated upper flat surface, a plate edge holding hand 154*a* at one end of the top arm 152*a*, a brace 156*a* connected to and extending downwardly from the bottom surface of the top arm 152*a*; a first (central) pivot bracket 158*a*; a second (central) pivot bracket 160*a* (labeled for ease of reference but not shown); a third pivot bracket 162*a*; and a fourth pivot bracket 164*a* (labeled for ease of reference but not shown). The elongated top arm 152*a* is configured such that part of the steel plate 25 can be positioned on the upper flat surface of the top arm 152*a* and the plate edge holding hand 154*a* is configured to be engaged by and support a side edge of the steel plate 25 as best shown in FIGS. 3 and 4. The brace 156*a* is configured to provide added support to the elongated top arm 152*a*.

The first (central) pivot bracket 158*a* includes a pivot pin receiving bearing 159*a* and the second (central) pivot bracket 160*a* includes a pivot pin receiving bearing 161*a* (labeled for ease of reference but not shown). It should be appreciated that the pivot pin PP1*a* extends from the first pivot pin supporter 130*a* through the pivot pin receiving bearing 159*a* of the first (central) pivot bracket 158*a*, through an opening (not shown) in the brace 156*a*, through the pivot pin receiving bearing 161*a* of the second (central) pivot bracket 158*a*, and into the pivot pin receipt opening 142*a* of the second pivot pin supporter 140*a* to provide a pivotable connection between the plate holder 150*a* and the first and second legs 114*a* and 124*a*. This arrangement enables the plate holder 150*a* to pivot between the loading position shown in FIGS. 3 and 5 and the transit position shown in FIGS. 2 and 4 under control of the jackscrew 190*a* as further described below.

The plate holder pivot actuator 180*a* includes a first linkage 181*a* and a second linkage 184*a*. The first linkage 181*a* includes a first pivot member receiver 182*a* at its top end and a second pivot member receiver 183*a* at its bottom end. Similarly, the second linkage 184*a* includes a first pivot member receiver 185*a* (labeled for ease of reference but not shown) at its top end and a second pivot member receiver 186*a* at its bottom end. The plate holder pivot actuator 180*a* is pivotally connected at its top end to the plate holder 150*a* by the second pivot pin PP2*a* (labeled for ease of reference but not shown) that is connected to the first pivot member receiver 182*a* of the first linkage 181*a*, extends through the third pivot bracket 162*a*, extends through the brace 156*a*, extends through the fourth pivot bracket 162*a*, and is connected to the first pivot member receiver 185*a* of the second linkage 184*a*. The plate holder pivot actuator 180*a* is pivotally connected at its bottom end to the jackscrew 190*a* by a third pivot pin PP3*a* (labeled for ease of reference but not shown) that is connected to the second pivot member receiver 183*a* of the first linkage 181*a*, extends through a pivot member receiver 191*a* of the jackscrew 190*a*, and that is connected to the second pivot member receiver 186*a* of the second linkage 184*a*. Various of these components thus form a second joint for pivotally supporting the plate holder 150*a*. Various of these components also form a third joint for pivotally supporting the plate holder 150*a* and for transferring the weight of the plate 25 to the follower 196*a* (described below) and to the deck 60.

As best shown in FIGS. 7, 8, 8B, and 8C, the first example jackscrew 190*a* includes an elongated rotatable threaded rod 192*a*, a follower 196*a* threadably moveably mounted on and journaled about the threaded rod 192*a*, the pivot member receiver 191*a* connected to the top of the follower 196*a*, and a drive coupler 198*a* connected to deck 60 and to the threaded rod 192*a*. The drive coupler 198*a* is connected to the threaded rod 192*a* and configured to rotate the threaded rod 192*a*. The drive coupler 198*a* is also connected to a right angle gearbox 340*a* of the drive assembly 300. The jackscrew 190*a* is thus connected to the drive assembly 300 and configured to be actuated by the drive assembly.

When the drive assembly 300 provides a rotational force in a first rotational direction via the right angle gearbox 340*a* (as discussed below) to the drive coupler 198*a*, the drive coupler 198*a* causes the rotation of the threaded rod 192*a* in that first rotational direction. The rotation of the threaded rod 192*a* in the first rotational direction causes the follower 196*a* to move on the threaded rod 192*a* from a transit position adjacent to the drive coupler 198*a* (shown in FIGS. 1, 2, 4, 7, 8 and 8B) to a load position adjacent to the free end of the threaded rod 192*a* (shown in FIGS. 3, 5, 6, and 8C). This movement of the follower 196*a* causes pivoting of the plate holder pivot actuator 180*a* at both ends and movement of the plate holder actuator 180*a* between the legs 114*a* and 124*a* from a downwardly angled position (shown in FIGS. 1, 2, 4, 7, and 8) to an upwardly angled position (shown in FIGS. 3, 5, and 6). This movement of the plate holder actuator 180*a* causes pivoting of the plate holder 150*a* from the transit position (shown in FIGS. 1, 2, 4, 7, and 8) to the loading/unloading position (shown in FIGS. 3, 5, and 6).

Likewise, when the drive assembly 300 provides a rotational force in a second rotational direction (opposite the first rotational direction) via the right angle gearbox 340*a* (as discussed below) to the drive coupler 198*a*, the drive coupler 198*a* causes the rotation of the threaded rod 192*a* in that second rotational direction. The rotation of the threaded rod 192*a* in the second rotational direction causes the follower 196*a* to move on the threaded rod 192*a* from the load position adjacent to the free end of the threaded rod 192*a* (shown in FIGS. 3, 5, 6, and 8C) to the transit position adjacent to the drive coupler 198*a* (shown in FIGS. 1, 2, 4, 7, 8, and 8B). This movement of the follower 196*a* causes pivoting of the plate holder pivot actuator 180*a* at both ends and movement of the plate holder actuator 180*a* between the legs 114*a* and 124*a* from an upwardly angled position (shown in FIGS. 3, 5, and 6) to a downwardly angled position (shown in FIGS. 1, 2, 4, 7, and 8). This movement of the plate holder actuator 180*a* causes pivoting of the plate holder 150*a* from the loading/unloading position (shown in FIGS. 3, 5, and 6) to the transit position (shown in FIGS. 1, 2, 4, 7, and 8).

It should be appreciated that the jackscrew 190*a* also functions as a stopping or braking mechanism for the plate holder 150*a*. Specifically, when the rod 192*a* of the jackscrew 190*a* is stationary, the follower 196*a* is held stationary by the rod 192*a*, the plate holder pivot actuator 180*a* is held stationary by the follower 196*a*, and the plate holder 150*a* is held stationary by the plate holder actuator 180*a*. Thus, in each of the loading/unloading and transit positions (and each position therebetween), the jackscrew 190*a* functions as a stopping or braking mechanism (as long as the rod 192*a* thereof is not rotating). In other words, the rods are configured not to rotate under normal forces except for intended rotational forces applied to the rods. In addition, the center of gravity of the large steel plate 25 is located laterally within approximately 12 inches of the centerline of the railcar 20 so that the motion of the drive assembly 300 is biased to rotate to the transit position such that the load on the drive assembly 300 is negligible. In alternative embodiments, one or more additional locking mechanisms (not shown) can be employed to releasably secure the plate holders in desired positions such as in the transit or in the loading/unloading positions.

As best shown in FIGS. 1, 2, 7, 8, 8A, 8B, and 8C, the drive assembly 300 includes: (1) two drive actuator connectors (not shown) at opposite ends of the railroad car 20; (2) a plurality of first drive shafts (not individually labeled except for first drive shafts 322*d*, 322*e*1, 322*e*2, and 322*f* shown in FIG. 8A) connected to the drive actuator connectors via a plurality of first linkages and/or couplers (not individually labeled); (3) a central gear reducer 330 connected to the first drive shafts 320*e*1 and 320*e*2; (4) a plurality of second drive shafts (not individually labeled except for second drive shafts 320*d*, 320*e*1, 320*e*2, and 320*f* shown in FIG. 8A) connected to the reducer 330 via a plurality of linkages (not individually labeled); and (5) a plurality of right angle gear boxes 340*a*, 340*b*, 340*c*, 340*d*, 340*e*, 340*f*, 340*g*, and 340*h* (best shown in FIGS. 1, 8A, 8B, and 8C) that are respectively connected to the drive couplers 198*a*, 198*b*, 198*c*, 198*d*, 198*e*, 198*f*, 198*g*, and 198*h* of the jackscrews 190*a*, 190*b*, 190*c*, 190*d*, 190*e*, 190*f*, 190*g*, and 190*h* of the plate supporters 110*a*, 110*b*, 110*c*, 110*d*, 110*e*, 110*f*, 110*g*, and 110*h*. The drive assembly 300 can includes a plurality of supports (not labeled) that support and securing these components to the deck 60 of the railroad car 20.

The drive actuator connectors are positioned, oriented, sized, shaped, and otherwise configured to each be releasably connected to a powered external drive actuator (not shown). The powered external drive actuator is thus releasably connectable to the drive assembly 300 via either drive actuator connector at either end of the railroad car 20. This enables a loader to operate the drive assembly 300 of the railroad car 20 from either end of the railroad car 20. It should be appreciated that when an operator is at either end of the railroad car 20, the operator does not need to be below any plates 25 held by the railroad car 20. The present disclosure contemplates that one or more powered external drive actuators will be located at each of the steel plate loading locations and the steel plate unloading locations. The present disclosure thus contemplates that, in various embodiments, the large plate tilt railroad car 20 does not need to include the drive actuators as part of such railroad car. This reduces the complexity, weight, and expense of the railroad car, and also reduces the maintenance associated with such drive actuators. This also enables the various embodiments of the railroad car of the present disclosure to be manufactured without any power source for the plate supporters 110*a*, 110*b*, 110*c*, 110*d*, 110*e*, 110*f*, 110*g*, and 110*h*.

A first group of the plurality of first drive shafts are connected to a first one of the drive actuator connectors at a first end of railroad car 20 and a second group of the plurality of drives shafts are connected to the second of the drive actuator connectors at a second end of the railroad car 20 such that the rotational forces provided by a drive shaft (not shown) of the powered external drive actuator (not shown) to either of the drive actuator connectors at either end of the railroad car 20 is transferred from that drive actuator connector through the respective set of first drive shafts to the gear reducer 330 The gear reducer 330 reduces the rotational force provided by the drive powered external drive actuator via the respective drive actuator connector and the respective group of first drive shafts, and transfers that reduced rotational force to the second drive shafts. The gear reducer 330 can be centrally positioned of railroad car 20 to provide more uniform torque distribution for the drive system. The second drive shafts respectively simultaneously transfer such reduced rotational force to the plurality of right angle gearboxes 340*a*, 340*b*, 340*c*, 340*d*, 340*e*, 340*f*, 340*g*, and 340*h* that in turn simultaneously transfer those reduced forces to the drive couplers 198*a*, 198*b*, 198*c*, 198*d*, 198*e*, 198*f*, 198*g*, and 198*h* of the jackscrews 190*a*, 190*b*, 190*c*, 190*d*, 190*e*, 190*f*, 190*g*, and 190*h*. Thus, it should be appreciated that the various pivot jackscrews and the drive assembly function as a plate supporter tilt drive system (for the plate supporter).

Figure 8D:
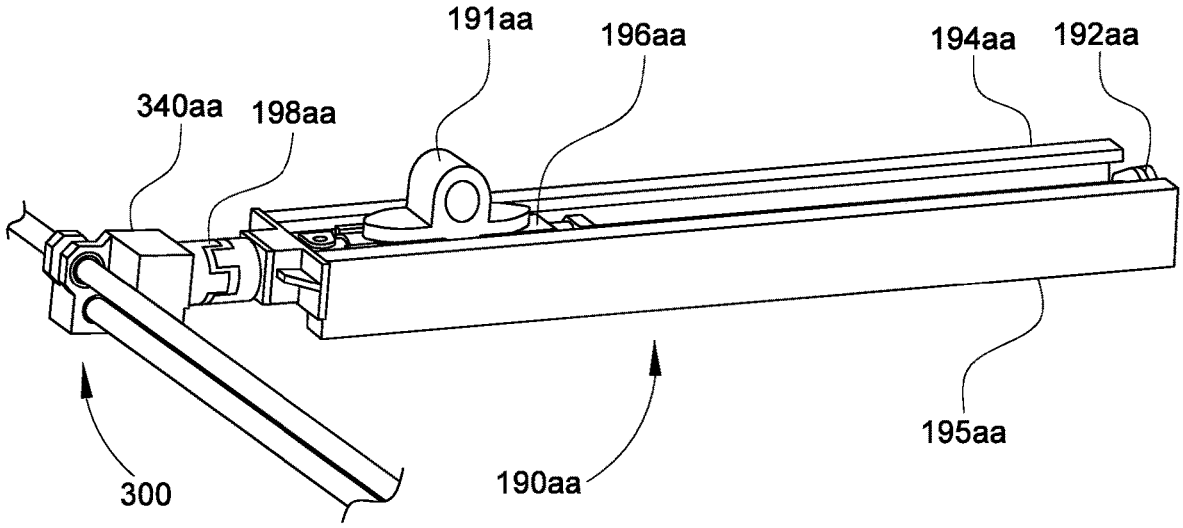
FIG. 8D is an enlarged fragmentary perspective view of part of the drive assembly and an alternative jackscrew of an alternative embodiment of the large plate tilt railroad car of FIG. 1.
Figure 8E:
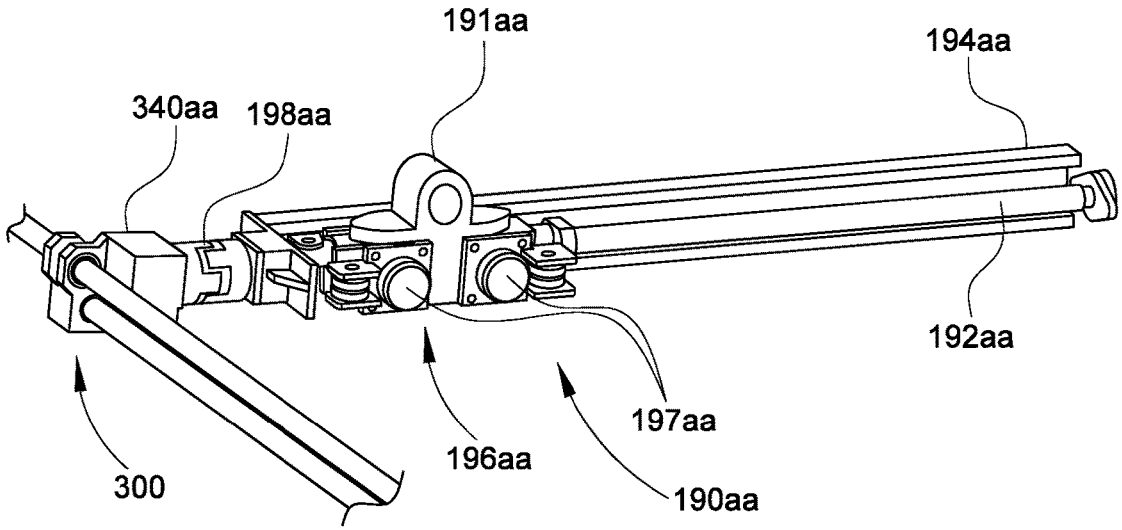
FIG. 8E is an enlarged fragmentary perspective view of part of the drive assembly and of the alternative jackscrew of the alternative large plate tilt railroad car of FIG. 8D.

Referring now to FIGS. 8D and 8E, an alternative jackscrew 190*aa* for the large plate tilt railroad cars of the present disclosure is illustrated. This form of the jackscrew can be used for each of the jackscrews of the railroad car 20. The jackscrew 190*aa* is substantially similar to the jackscrew 190*a* and includes an elongated rotatable threaded rod 192*aa*, a follower 196*aa* threadably moveably mounted on and journaled about the threaded rod 192*aa*, the pivot member receiver 191*aa* connected to the top of the follower 196*aa*, and a drive coupler 198*aa* connected to deck 60 and to the threaded rod 192*aa*. The drive coupler 198*aa* is configured to rotate the threaded rod 192*aa*. The drive coupler 198*aa* is also connected to the drive assembly 300 via the right angle gearbox 340*aa*. This jackscrew 190*aa* further includes opposing tracks 194*aa* and 195*aa* that limit the movement of the follower 196*aa*. Specifically, the follower 196*aa* includes spaced-apart freely rotatable cylindrical follower support members 197*aa* (such as wheels, rollers, or other features that restrict vertical and lateral movement) and that rest and move within the upper, lower, and side internal surfaces (not labeled) of the tracks 194*aa* and 195*aa*. In various such embodiments, the cylindrical follower support members 197*aa* move on the deck 60 and thus transfer the weight of the plate to the deck 60. This configuration enables substantial portions of the weight of the plate 25 held by the plate holders to be transferred through the plate holder pivot actuators to the follower 196*aa* to the tracks 194*aa* and 195*aa* and to the deck of the railroad car. Thus, this embodiment is one way to avoid substantial weight being placed on the rod 192*aa* and thus avoid potential bending of the rod 192*aa* of the jackscrew 190*aa*. This embodiment decouples the forces due to the weight of the plate 25 from the rods of the jackscrews. In various embodiments, the threaded rod 192*aa* can be connected to and supported at either or both ends by suitable interior threaded rod supports (not shown). In various embodiments, one or more of the interior threaded rod supports can be connected to tracks 194*aa* and 195*aa*. In various embodiments, the drive coupler 198*aa* can be connected to one of the interior threaded rod supports as well as to the threaded rod 192*aa* (such that the drive coupler 198*aa* is configured to rotate the threaded rod 192*aa*).

Figure 2:
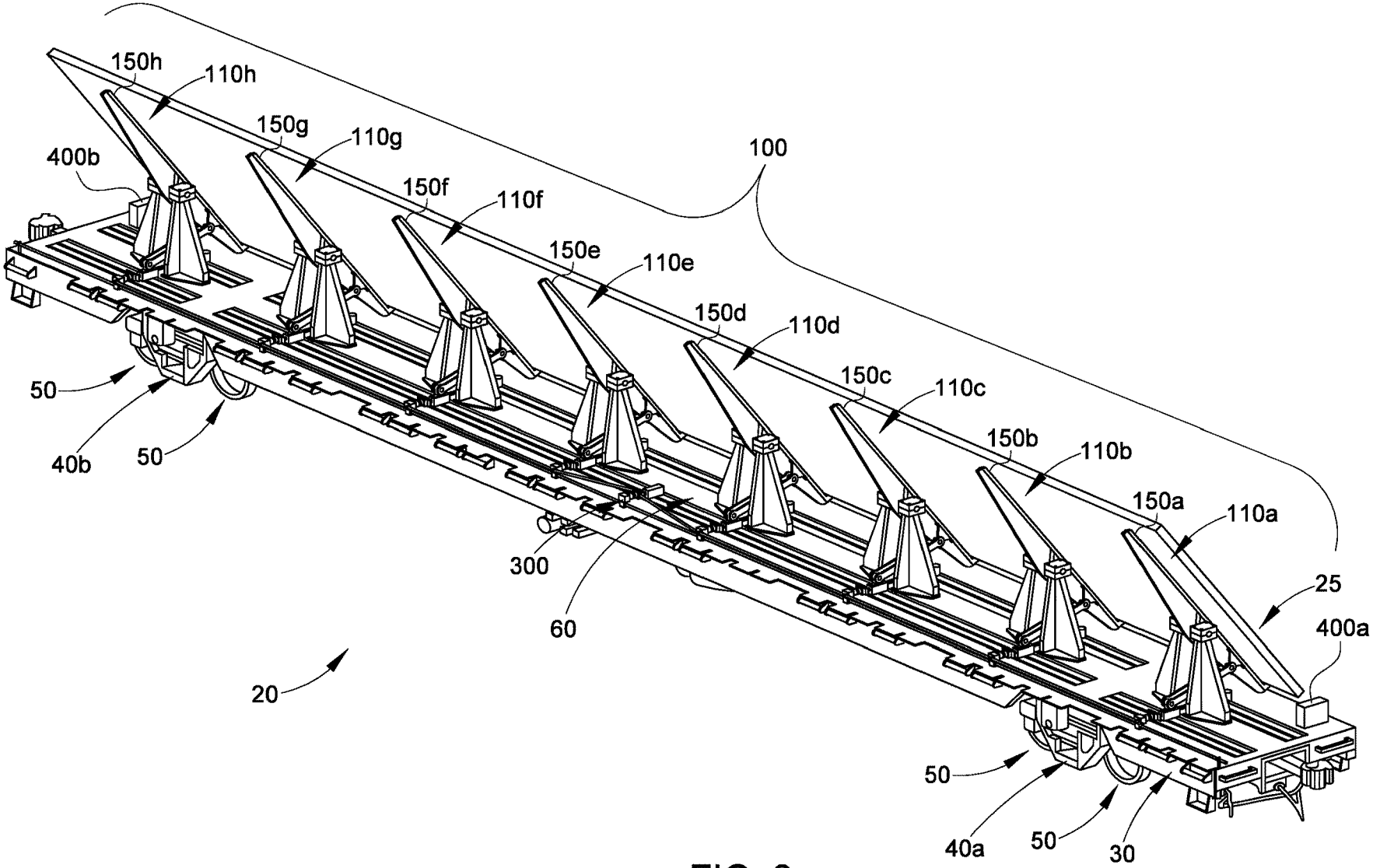
FIG. 2 is a top perspective view of the loaded large plate tilt railroad car of FIG. 1 shown supporting an example large steel plate in a transit position.

FIGS. 1 and 2 show that the railroad car 20 further includes two plate movement blockers 400*a* and 400*b* connected to the deck 60 at the opposite ends of the railroad car 20. The plate movement blockers 400*a* and 400*b* are sized, shaped, configured, and positioned to prevent the plate 25 from longitudinally moving on the railroad car 20 when the plate 25 is in the transit position. It should be appreciated that these plate movement blockers 400*a* and 400*b* can be alternatively positioned, sized, shaped, and otherwise configured in accordance with the present disclosure (such as but not limited to the other example plate movement blockers described below). It should also be appreciated that in alternative embodiments, one or more of the plate movement blockers can be adjustable to fit different size plates.

In various embodiments, the present disclosure contemplates the following method for operating the railroad car 20 to load one or more large plates (such as steel plate 25) on the railroad car 20: (a) moving the railroad car 20 to a position at a loading area where one or more large steel plates can be loaded by a crane onto the railroad car 20 (such as at a loading area of a manufacturing facility of the large steel plates); (b) connecting a powered external drive actuator to one of the drive actuator connectors of the drive assembly 300 of the railroad car 20; (c) activating the powered external drive actuator to cause the plate holders 150*a* to 150*h* of the plate supporters 110*a* to 110*h* to pivot to their respective loading positions (shown in FIGS. 3, 5, and 6); (d) loading one or more large steel plates by a crane onto the plate holders 150*a* to 150*h* of the plate supporters 110*a* to 110*h* while they are in their respective loading positions (shown in FIGS. 3, 5, and 6); (e) activating the powered external drive actuator to cause the plate holders 150*a* to 150*h* of the plate supporters 110*a* to 110*h* to pivot to their respective transit position with the steel plate(s) 25 thereon (as shown in FIGS. 2 and 4); (f) dis-connecting the powered external drive actuator from the respective drive actuator connector of the drive assembly 300 of the railroad car 20; and (g) moving the railroad car 20 from the loading area with the one or more large steel plates held by the plate holders 150*a* to 150*h* of the plate supporters 110*a* to 110*h* in their respective transit positions.

In this example embodiment, step (c) includes activating the powered external drive actuator to cause the powered external drive actuator to provide rotational force in a first direction to the respective drive actuator connector of the drive assembly 300 such that the drive assembly 300 simultaneously transfers that rotational force to the jackscrews 190*a* to 190*h* to cause the threaded rods of the jackscrews 190*a* to 190*h* to simultaneously rotate to cause the followers of the jackscrews 190*a* to 190*h* to transversely move toward the respective second ends of the rods. The transverse movements of the followers of the jackscrews cause the pivot member receivers connected to the followers to simultaneously transversely move and the plate holder pivot actuators (that each include the respective linkages thereof) to simultaneously pivot upwardly to cause the plate holders 150*a* to 150*h* to simultaneously pivot upwardly from the downwardly angled transit positions (shown in FIGS. 1, 2, 4, 7, and 8) to the horizontally extending loading positions (shown in FIGS. 3, 5, and 6).

In this example embodiment, step (e) includes activating the external drive actuator to cause the external drive actuator to provide rotational force in a second direction (that is opposite the first direction)) to the respective drive actuator connector of the drive assembly 300 such that the drive assembly 300 simultaneously transfers that rotational force to the jackscrews 190*a* to 190*h* to cause the threaded rods of the jackscrews 190*a* to 190*h* to simultaneously rotate to cause the followers of the jackscrews 190*a* to 190*h* to transversely move toward the respective first ends of the rods of the jackscrews. The transverse movements of the followers cause the pivot member receivers connected to the followers to simultaneously transversely move and the plate holder pivot actuators (that each include the respective linkages thereof) to simultaneously pivot downwardly to cause the plate holders 150*a* to 150*h* to simultaneously pivot downwardly from the loading positions (shown in FIGS. 3, 5, and 6) to the downwardly angled transit positions (shown in FIGS. 1, 2, 4, 7, and 8).

In this embodiment, the present disclosure contemplates the following method for operating the railroad car 20 to unload one or more large steel plates from the railroad car 20: (a) moving the railroad car 20 with the one or more large steel plates held by the plate holders 150*a* to 150*h* of the plate supporters 110*a* to 110*h* in their respective transit positions to an unloading area to be unloaded by a crane from the railroad car 20 (such as at an unloading area of a manufacturing facility that will use the large steel plates for manufacturing purposes); (b) connecting a powered external drive actuator to one of the drive actuator connectors of the drive assembly 300 of the railroad car 20; (c) activating the powered external drive actuator to cause the plate holders 150*a* to 150*h* of the plate supporters 110*a* to 110*h* to pivot with the steel plate(s) to their respective unloading positions (shown in FIGS. 3, 5, and 6); (d) unloading one or more large steel plates by a crane from the plate holders 150*a* to 150*h* of the plate supporters 110*a* to 110*h* while they are in their respective unloading positions (shown in FIGS. 3, 5, and 6); (e) activating the powered external drive actuator to cause the plate holders 150*a* to 150*h* of the plate supporters 110*a* to 110*h* (without any steel plates) to pivot to their respective transit positions after the steel plates are unloaded; (f) dis-connecting the powered external drive actuator from the respective drive actuator connector of the drive assembly 300 of the railroad car 20; and (g) moving the railroad car 20 to from the unloading area with the plate holders 150*a* to 150*h* of the plate supporters 110*a* to 110*h* in their respective transit positions.

In this embodiment, step (j) is similar to step (c) explained above and is thus not explained again for brevity. In this embodiment, step (l) is similar to step (e) explained above and is thus not explained again for brevity.

It should be appreciated that the present disclosure contemplates that the powered exterior drive actuators that are connected to the drive assembly 300 and used to actuate the drive assembly 300 will be located at the steel plate loading locations and at the steel plate unloading locations, and thus do not need to be part of the railroad car 20.

It should also be appreciated that the present disclosure contemplates that the powered drive actuator(s) that is/are connected to the drive assembly 300 and used to actuate the drive assembly 300 can alternatively be part of the railroad car 20. In certain such embodiments, the powered drive actuator(s) is/are can be powered by an external power source connectable to the drive actuator. In other such embodiments, the drive actuator(s) is/are powered by a power source connected to the drive actuator and on the railroad car 20.

The various components of the plate support assembly 100 and of the drive assembly 300 are made of steel in this example embodiment. It should be appreciated that one or more of such components can be alternatively shaped, sized, configured, and made of different materials in accordance with the present disclosure.

It should be appreciated that the plate support assembly 100 and of the drive assembly 300 of the present disclosure provides a stable support for the steel plates 25. In particular, the jackscrews and the plate holder pivot actuators (that are connected to each other and respectively connected to the drive assembly and the plate holders) are configured to hold the plate holders and any steel plates thereon) in secure stationary positions unless the rods of the jackscrews are rotated (as explained above).

Referring now to FIGS. 9 to 14, a large plate tilt railroad car 1020 of another example embodiment of the present disclosure is generally illustrated. This large plate tilt railroad car 1020 is generally different than the large plate tilt railroad car 20 in the shape of the deck 1060, the quantity of plurality of spaced-apart plate supporters 1110*a* to 1110*f*, and the lengths of the plate holders 1150*a* to 1150*f*, which collectively enable the railroad car 1020 to hold and transport wider steel plates.

Similar to the large plate tilt railroad car 20, this large plate tilt railroad car 1020 generally includes: (1) a frame 1030; (2) spaced apart trucks 1040*a* and 1040*b* configured to support the frame 1030; (3) a plurality of wheels 1050 that support the trucks 1040*a* and 1040*b*; (4) a deck 1060 connected to and supported by the frame 1030; and (5) a plate support assembly 1100 connected to, extending upwardly from, and supported by the deck 1060 (and thus supported by the frame 1030, the trucks 1040*a* and 1040*b*, and the wheels 1050). The plate support assembly 1100 is configured to securely support one or more large plates such as the second example large steel plate 25A shown in FIGS. 9, 10, and 13, and such as the third example large steel plate 25B shown in FIGS. 11, 12, and 14.

Figure 9:
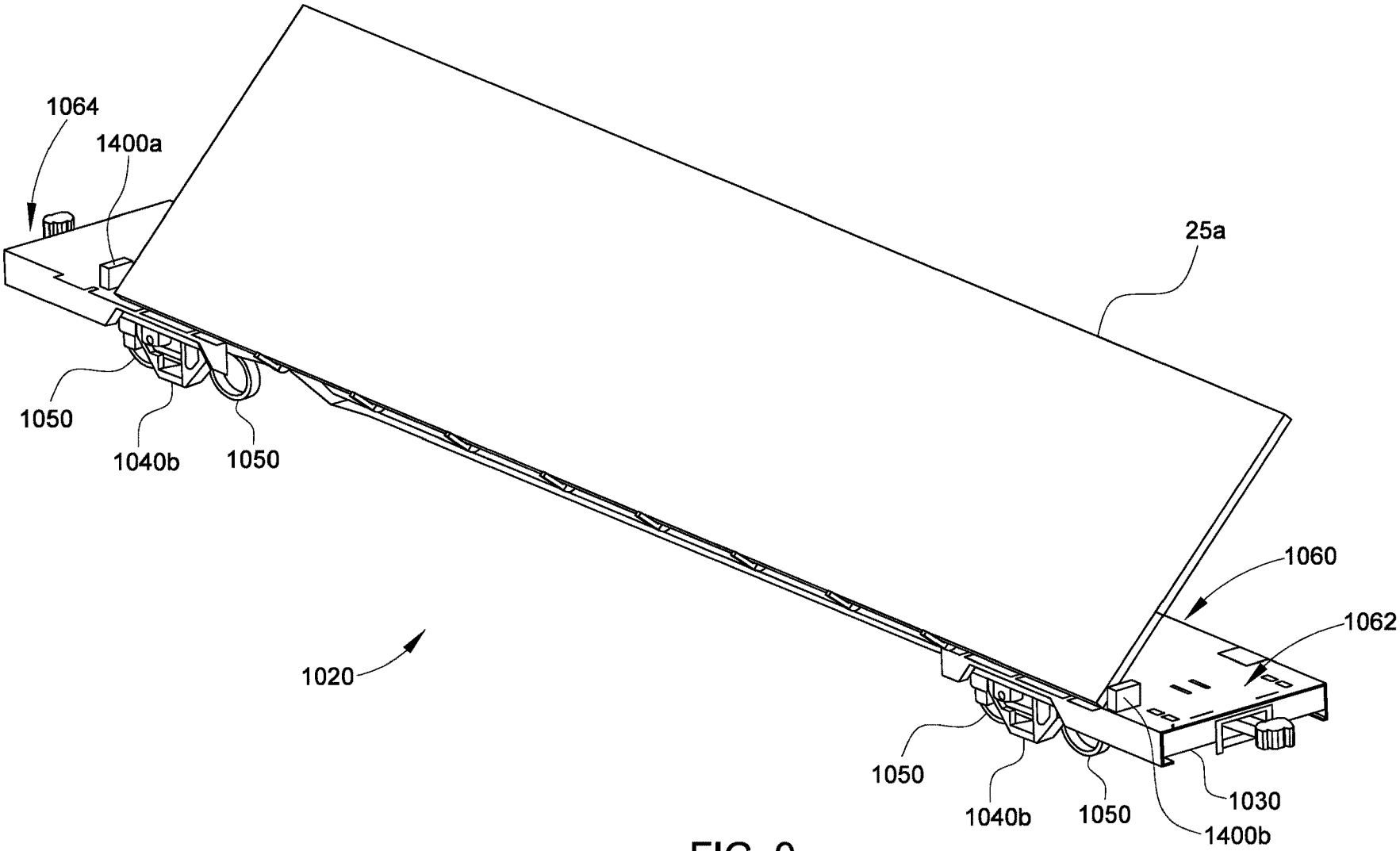
FIG. 9 is a top perspective view of a loaded large plate tilt railroad car of another example embodiment of the present disclosure shown supporting an example large steel plate of a first size in a transit position.
Figure 10:
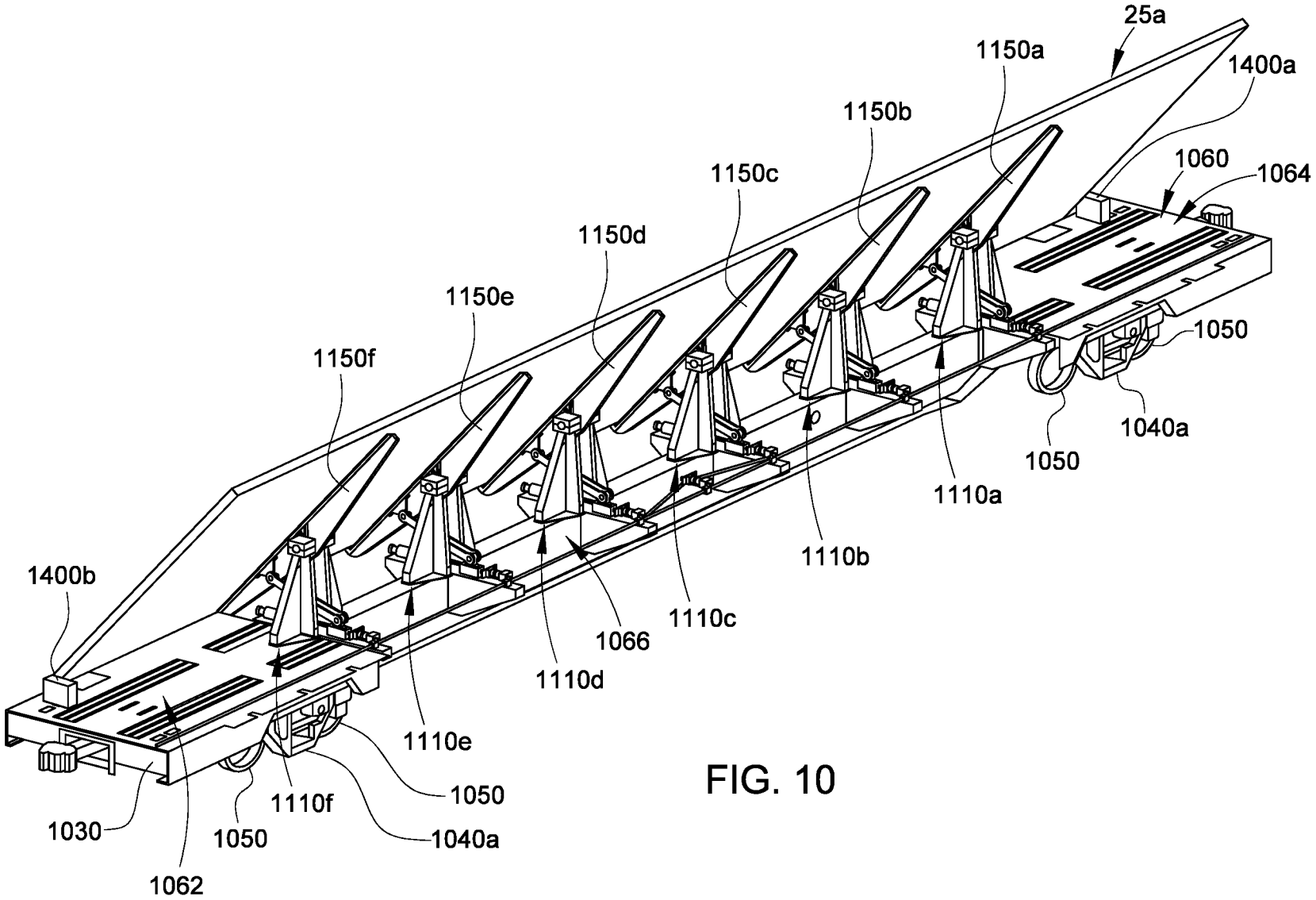
FIG. 10 is a top perspective view of the loaded large plate tilt railroad car of FIG. 9 shown supporting the first size example large steel plate in the transit position.
Figure 11:
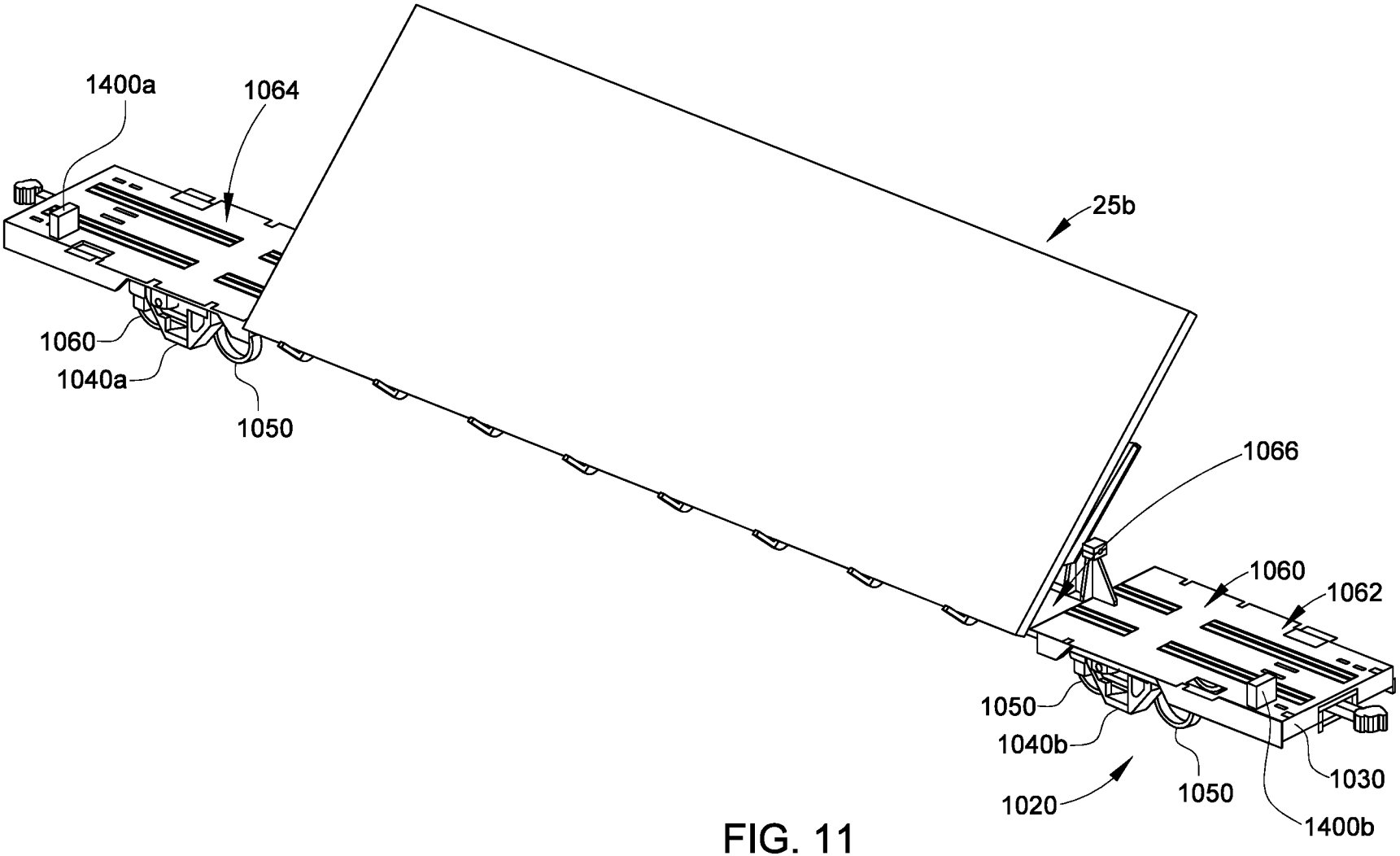
FIG. 11 is a top perspective view of the loaded large plate tilt railroad car of FIG. 9 shown supporting a second size example large steel plate in the transit position.
Figure 12:
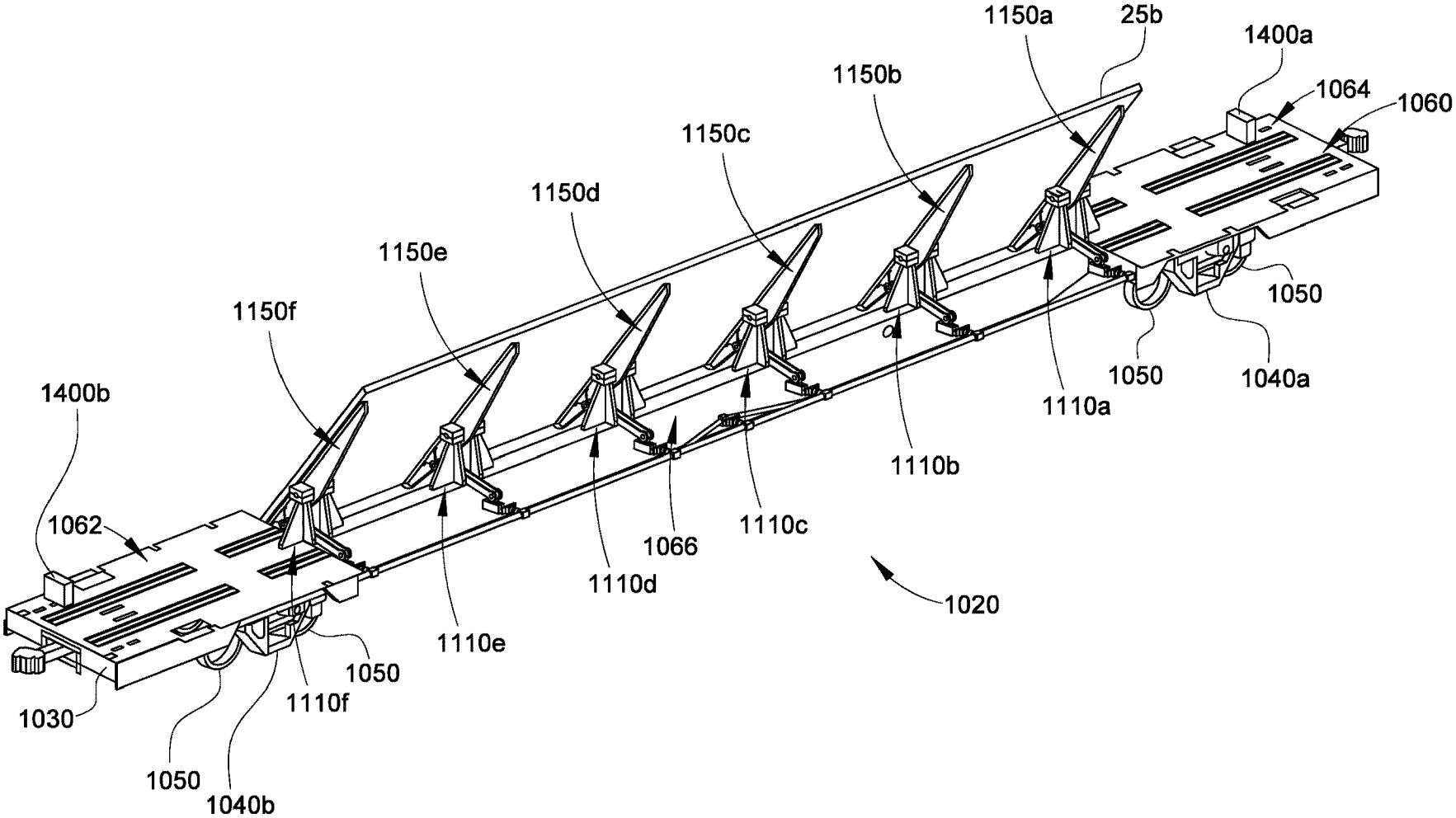
FIG. 12 is a top perspective view of the loaded large plate tilt railroad car of FIG. 9 shown supporting the second size example large steel plate in the transit position.
Figure 14:
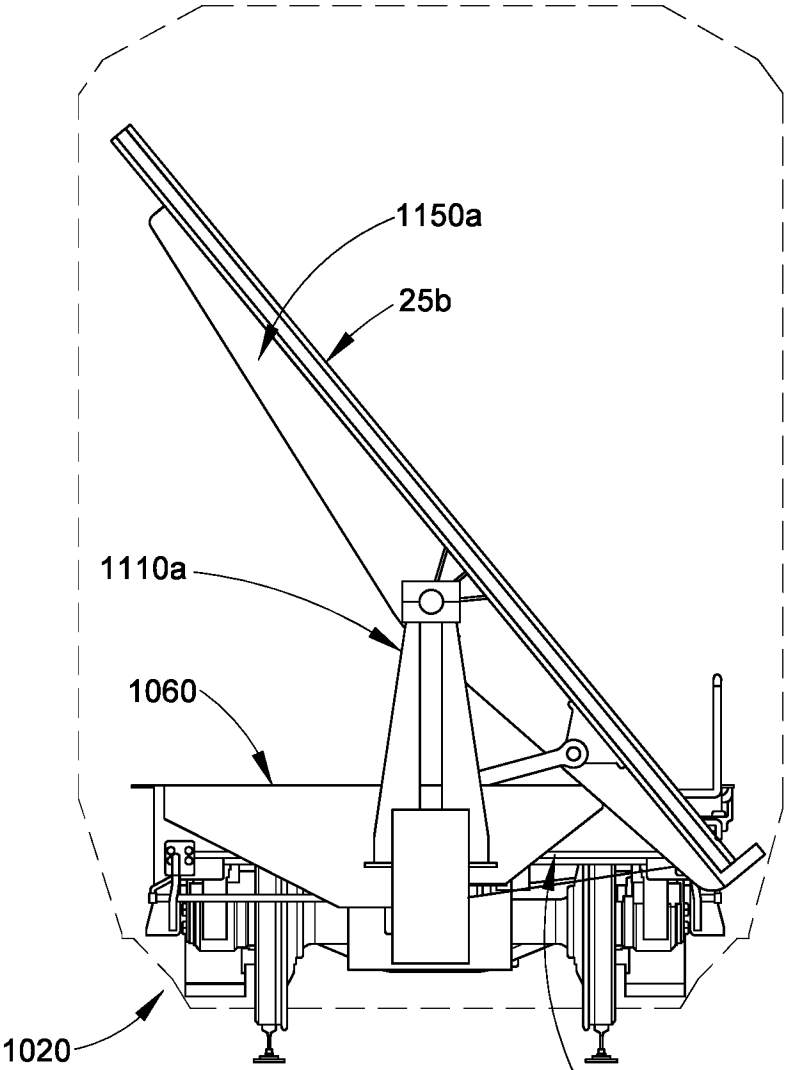
FIG. 14 is an end view of the loaded large plate tilt railroad car of FIG. 9 supporting the second size example large steel plate in the transit position, and with certain components removed to reveal other components.
Figure 13:
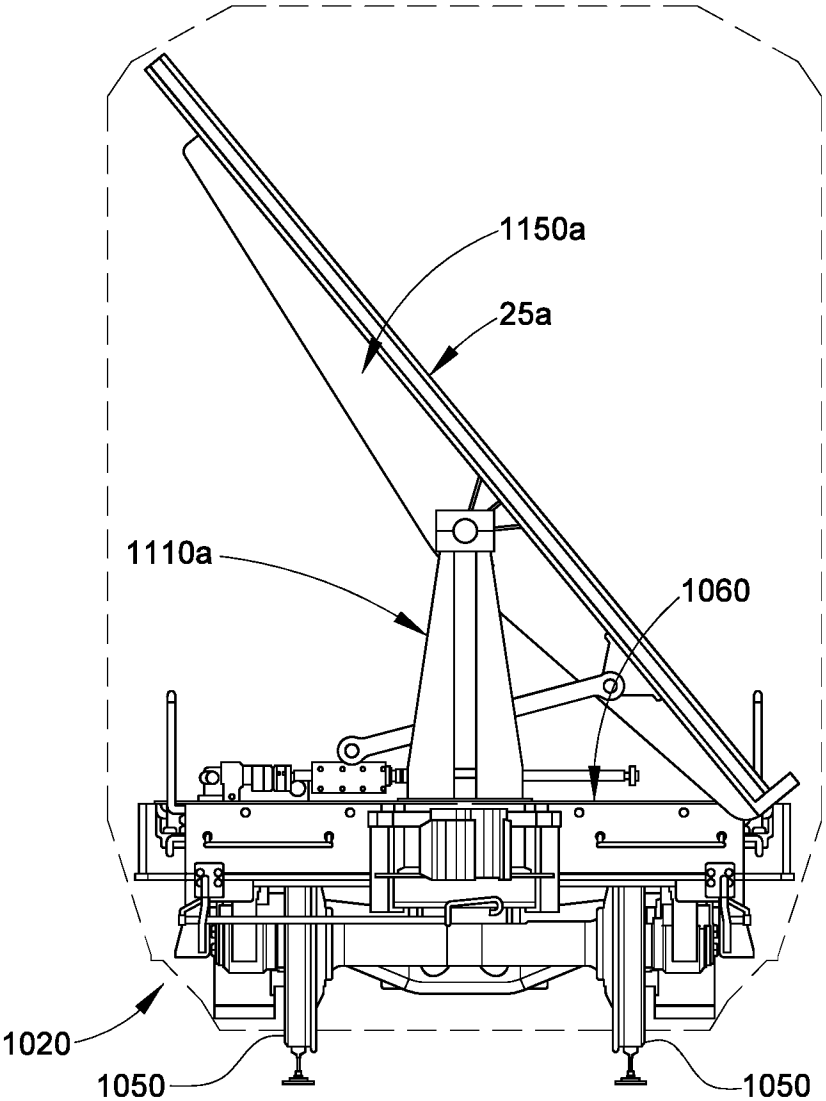
FIG. 13 is an end view of the loaded large plate tilt railroad car of FIG. 9 supporting the first size example large steel plate in the transit position, and with certain components removed to reveal other components.

In this example embodiment, the deck 1060 includes a first end portion 1062, a second end portion 1064, and a center portion 1066 between the first end portion 1062 and the second end portion 1064. The first end portion 1062 and the second end portion 1064 are of a similar width and the center portion 1066 has a narrower width than the first end portion 1062 and the second end portion 1064. The first end portion 1062, the second end portion 1064, and the central portion 1066 define a longitudinally extending frame recess area (not labeled). The narrower width of the center portion 1066 and the frame recess area enable parts of the plate support assembly 1100 and particularly certain parts of the plate holders 1150*a* to 1150*f* to extend in the recess between the first end portion 1062 and the second end portion 1064 such as shown in FIGS. 9, 10, and 13. The narrower width of the center portion 1066 and the frame recess enable a wider but shorter steel plate 25B to extend between the first end portion 1062 and the second end portion 1064 such as shown in FIGS. 11, 12, and 14.

More specifically, in this example embodiment, the plate support assembly 1100 includes a plurality of spaced-apart plate supporters 1110*a*, 1110*b*, 1110*c*, 1110*d*, 1110*e*, and 1110*f* connected to the center portion 1066 of the deck 1060 and that respectively include a plurality of plate holders 1150*a*, 1150*b*, 1150*c*, 1150*d*, 1150*e*, and 1150*f*. The plurality of plate holders 1150*a*, 1150*b*, 1150*c*, 1150*d*, 1150*e*, and 1150*f* are operably simultaneously movable (and particularly pivotable) from: (a) loading/unloading positions (not shown) in which one or more large steel plates such as plates 25A and 25B can be loaded on the railroad car 1020, to (b) transit positions (shown in FIGS. 9, 10, 11, 12, 13, and 14) in which one or more large steel plates such as plates 25A or 25B can be transported using the railroad car 1020, in a same manner as described above with respect to the plurality of plate holders 150*a* to 150*h*.

As explained above, the large steel plates are also so wide that they need to be transported at an angle so that they fit within the maximum outer dimensions allowed for railroad cars. These outer dimensions are generally indicated by the dotted lines in FIGS. 13 and 14. FIG. 14 shows that in the angled transit positions, the plurality of plate holders 1150*a*, 1150*b*, 1150*c*, 1150*d*, 1150*e*, and 1150*f* and the steel plate 25B are within the allowable maximum outer dimensions indicated by the dotted line. FIG. 14 also shows that in the angled transit positions, the plurality of plate holders 1150*a*, 1150*b*, 1150*c*, 1150*d*, 1150*e*, and 1150*f* and the steel plate 25B can extend within the recess area between the first end section 1062 and the second end section 1064 of the deck 1160.

The plate support assembly 100 and specifically the plurality of spaced-apart plate supporters 1110*a* to 1110*f* are configured to move the plurality of plate holders 1150*a* to 1150*f* to the loading/unloading positions for the loading and unloading of the large steel plates on the (stationary) railroad car 20 and to the transit positions for transit of the large steel plates by the railroad car 20. The plate support assembly 1100 includes a drive assembly 1300 configured to cause the plurality of plate holders 1150*a* to 1150*f* to simultaneously move from the loading/unloading positions to the transit positions, and to simultaneously move and from the transit position to the loading/unloading positions. In this illustrated example embodiment, the drive assembly 1300 is actuatable by one or more powered external drive actuators (not shown) removably connectable to the drive assembly 1300. In other embodiments, the drive assembly 1300 is actuatable by one or more powered drive actuators (not shown) that is/are part of the railroad car 1020 such as one or more drive motors mounted to or on the deck 60 of the railroad car 1020.

In this illustrated example embodiment, the plate support assembly 100 generally includes six plate supporters 1110*a*, 1110*b*, 1110*c*, 1110*d*, 1110*e*, and 1110*f*, that are each driven plate supporters and that are each coupled to the drive assembly 1300. In this example embodiment, when one or more steel plates such as plate 25A or 25B are positioned on the plate holders 1150*a* to 1150*f* of the plate supporters 1110*a* to 1110*f*, the plate holders 1150*a* to 1150*f* of the driven plate supporters 1110*a* to 1110*f* can all be moved simultaneously. It should also be appreciated that the quantity of plate supporters and can vary in accordance with the present disclosure. It should further be appreciated that the positions of the plate supporters can vary in accordance with the present disclosure. In other embodiments, the plate support assembly can include two different types of plate supporters. Specifically, certain of the plate supporters can be driven plate supporters that are coupled to the drive assembly and one or more of the plate supporters are not driven, are not coupled to the drive assembly, and are thus follower plate supporters (not shown).

Since all of the plate supporters 1110*a* to 1110*f* are identical in this example embodiment, and similar to or identical the plate supporter 110*a* described above, these plate supporters 1110*a* to 1110*f* are not described in detail herein for brevity. Since drive assembly 1300 is similar to the drive assembly 300 described above, the drive assembly 1300 is not described in detail herein for brevity. Since the operation of the plate supporters 1110*a* to 1110*f* and the drive assembly 1300 is similar to the plate supporters 110*a* to 110*h* and the drive assembly 300 described above, the operation of the plate supporters 1110*a* to 1110*f* and the drive assembly 1300 are not described in detail herein for brevity.

FIGS. 9, 10, 11, and 12 show that the railroad car 1020 further includes two plate movement blockers 1400*a* and 1400*b* connected to the deck 1060 at the opposite ends of the railroad car 1020. The plate movement blockers 1400*a* and 1400*b* are sized, shaped, configured and positioned to prevent the plate 25 from longitudinally moving on the railroad car 1020 when the plate 25 is in the transit position. It should be appreciated that these plate movement blockers 1400*a* and 1400*b* can be alternatively positioned, sized, shaped, and otherwise configured in accordance with the present disclosure. It should also be appreciated that in alternative embodiments, one or more of the plate movement blockers can be adjustable to fit different size plates. It should also be appreciated that depending upon the length of the plate 25, parts of the deck 1060 itself can function as blockers or to block the longitudinal movement of the plate 25 as shown in FIGS. 11 and 12.

The various components of the plate support assembly 1100 and of the drive assembly 1300 are made of steel in this example embodiment. It should be appreciated that one or more of such components can be alternatively shaped, sized, configured, and made of different materials in accordance with the present disclosure.

It should also be appreciated be appreciated from this example embodiment that the configuration and size of the railroad car can vary in accordance with the present disclosure.

The present disclosure contemplates that the configuration of the plate edge holding hands of the plate holders of the plate supports that hold the bottom edges of the steel plates can vary in accordance with the present disclosure.

Figure 15:
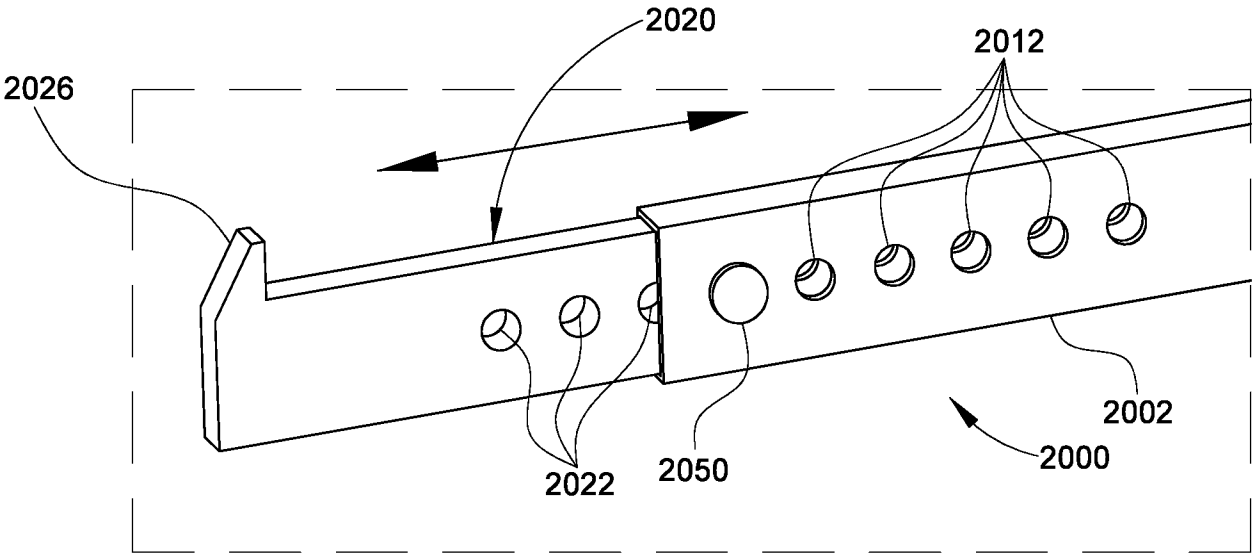
FIG. 15 is a fragmentary side perspective view of an alternative plate edge holding hand of a plate holder of a plate support for a large plate tilt railroad of one example embodiment of the present disclosure.

FIG. 15 shows one alternative example embodiment of a plate edge holding hand 2000 of a plate holder of a plate support for a large plate tilt railroad car of the present disclosure. This example plate edge holding hand 2000 includes a tubular receiver 2002 at an end of the plate holder (not shown). The tubular receiver 2002 defines a plurality of transversely extending locking pin receipt openings collectively labeled 2012—each configured to receive a removable locking pin 2050. The tubular receiver 2002 also defines a tubular opening (not labeled) configured to slidably receive a moveable palm 2020. The movable palm 2020 defines a plurality of locking pin receipt openings collectively labeled 2022 and that are alignable with the locking pin receipt openings 2012 such that the palm 2020 can be secured to the receiver 2002 by the locking pin 2050 at any one of a plurality of different positions. This configuration makes the plate edge holding hand 2000 adjustable for different sized plates. The palm 2020 also includes a finger 2026 having an outwardly extending end 2026 for engagement with the edge of the plate.

Figure 16:
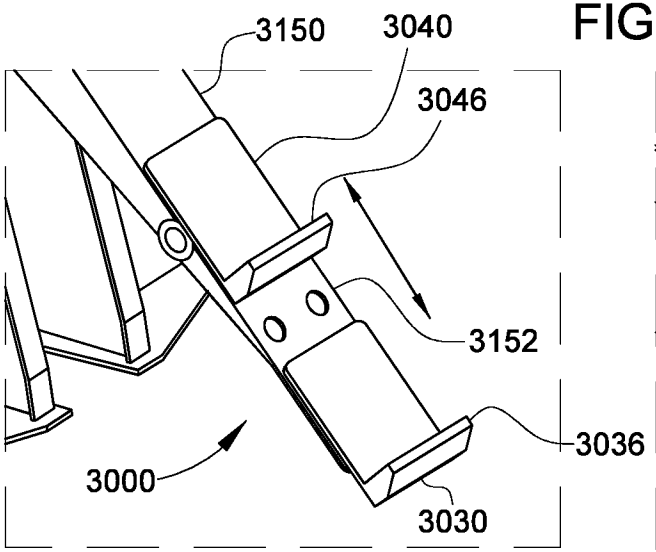
FIG. 16 is a fragmentary side perspective view of another alternative plate edge holding hand of a plate holder of a plate support for a large plate tilt railroad of one example embodiment of the present disclosure.
Figure 17:
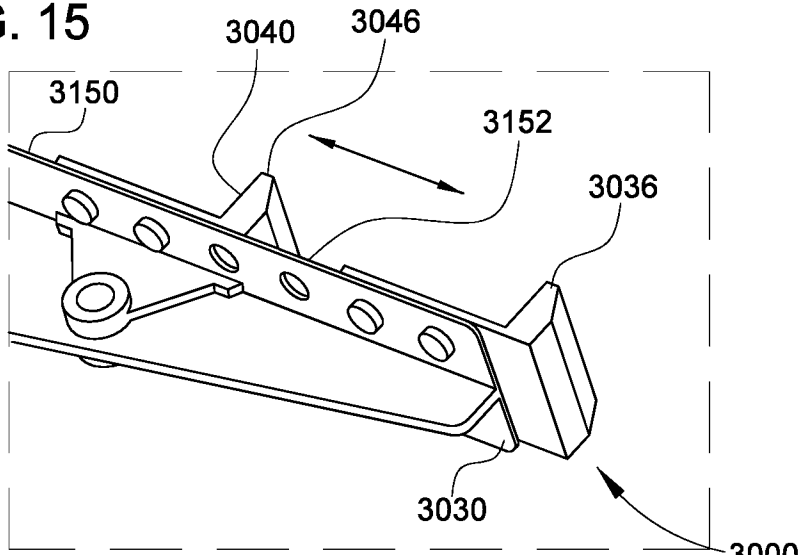
FIG. 17 is a fragmentary bottom perspective view of the plate edge holding hand of FIG. 16.

FIGS. 16 and 17 show another alternative example embodiment of a plate edge holding hand of a plate holder of a plate support for a large plate tilt railroad car of the present disclosure. This example plate edge holding hand 3000 includes aligned pairs of attachment openings (not labeled) in the upper flat surface of the elongated top arm 3152 (that is otherwise similar to arm 152*a* described above). This example plate edge holding hand 3000 includes a moveable finger connected at different locations on the upper flat surface of the elongated top arm 3152. FIGS. 16 and 17 show the locations that an example movable finger such as either finger 3030 or finger 3040 can be positioned. For example, finger 3030 can be positioned at an end most position or finger 3040 can be positioned at a position inwardly of the end most position. In this embodiment, finger 3030 includes an outwardly extending end 3036 for engagement with the edge of the plate and locking pins (not labeled) for securement to the top arm 3150. In this embodiment, finger 3040 includes an outwardly extending end 3046 for engagement with the edge of the plate and locking pins (not labeled) for securement to the top arm 3150.

The various components of the plate edge holding hands 2000 and 300 are made of steel in these example embodiments. It should be appreciated that one or more of such components can be alternatively shaped, sized, configured, and made of different materials in accordance with the present disclosure.

Referring now to FIGS. 18, 19, 20, 21, 22, 23, 24, and 25, a large plate tilt railroad car 4020 of another example embodiment of the present disclosure is partially illustrated. This large plate tilt railroad car 4020 is different than the large plate tilt railroad car 20 described above primarily in that it includes different plate movement blockers at each end of the railroad car 4020. In various embodiments, these plate movement blockers 4400*a* and 4400*b* are mirror images of each other (at each respective end of the railroad car), and thus only plate movement blocker 4400*a* is primarily described herein for brevity.

These plate movement blockers 4400*a* and 4400*b* can be provided in addition to or instead of the plate movement blockers 400*a* and 400*b* that are connected to the deck of the railroad car at the opposite ends of the railroad car as described above. These plate movement blockers 4400*a* and 4400*b* are positioned, sized, shaped, otherwise configured to prevent a plate (such as the steel plate 25 described above) that is being transported by the railroad car 4020 from longitudinally moving or substantially moving on the railroad car 4020 when the plate 25 is in the loading or transit positions.

Generally, the illustrated example railroad car 4020 includes plate movement blockers 4400*a* and 4400*b*) at respective ends of the railroad car 4020. The plate movement blockers 4400*a* and 4400*b* respective include bulkheads 4530*a* and 4530*b* configured to limit the longitudinal movements of the plate. The plate movement blockers 4400*a* and 4400*b* respectively include moveable gates 4540*a* and 4540*b* configured to prevent transverse movements of the plate. In various such embodiments, each such plate movement blocker also includes one or more load transfer assemblies configured to transfer forces incurred by the bulkhead thereof to the deck 4060 of the railroad car 4020.

More specifically, the illustrated example plate movement blocker 4400*a* includes: (1) a first plate blocker 4500*a*; (2) an anchor 4600*a*; (3) a first (or upper) load transfer assembly 4700; (4) a second (or lower) load transfer assembly 4800; and (5) a third load transfer assembly 4900.

Figure 18:
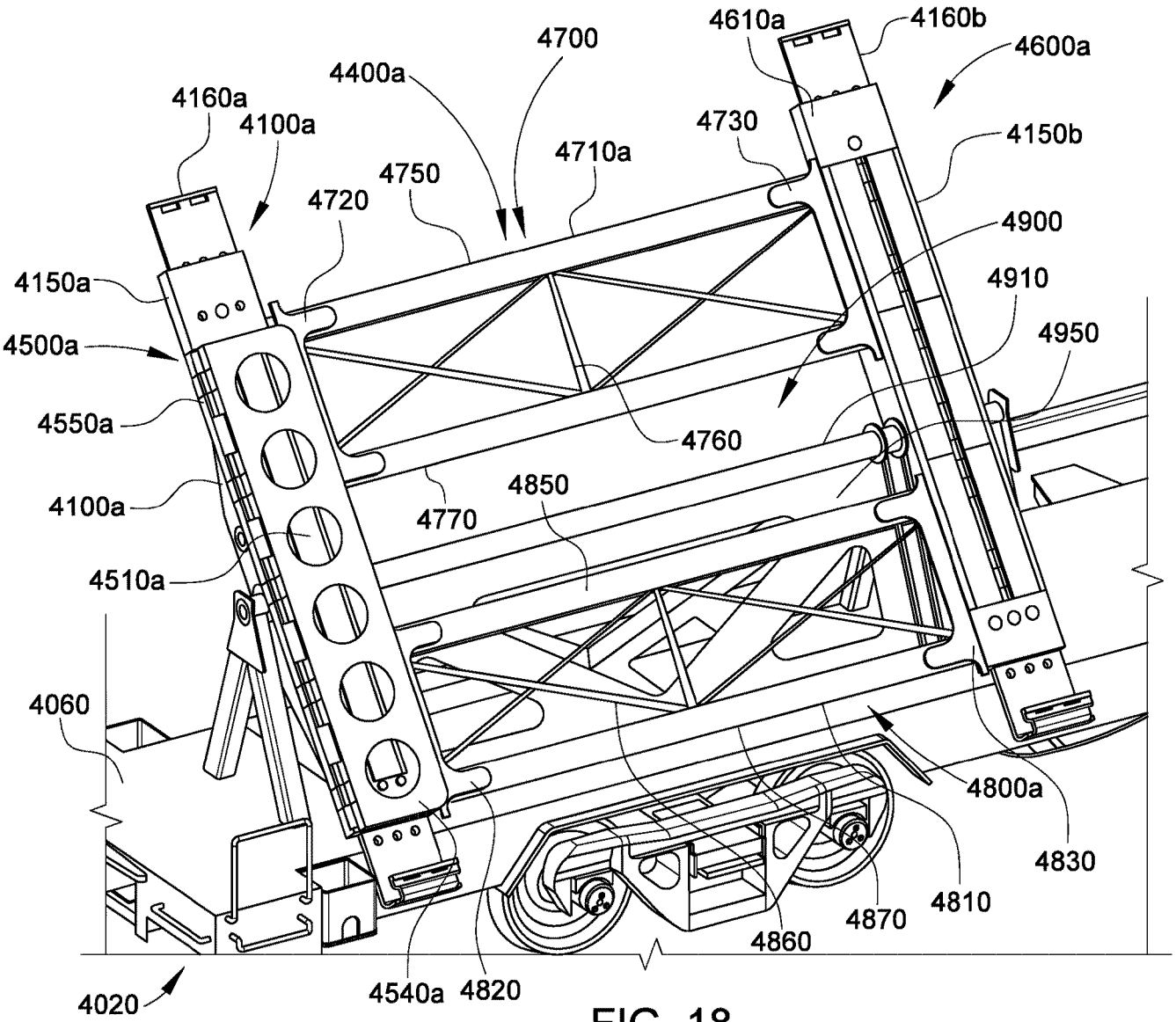
FIG. 18 is fragmentary first side perspective view of a first end section of an unloaded large plate tilt railroad car of another example embodiment of the present disclosure.
Figure 19:
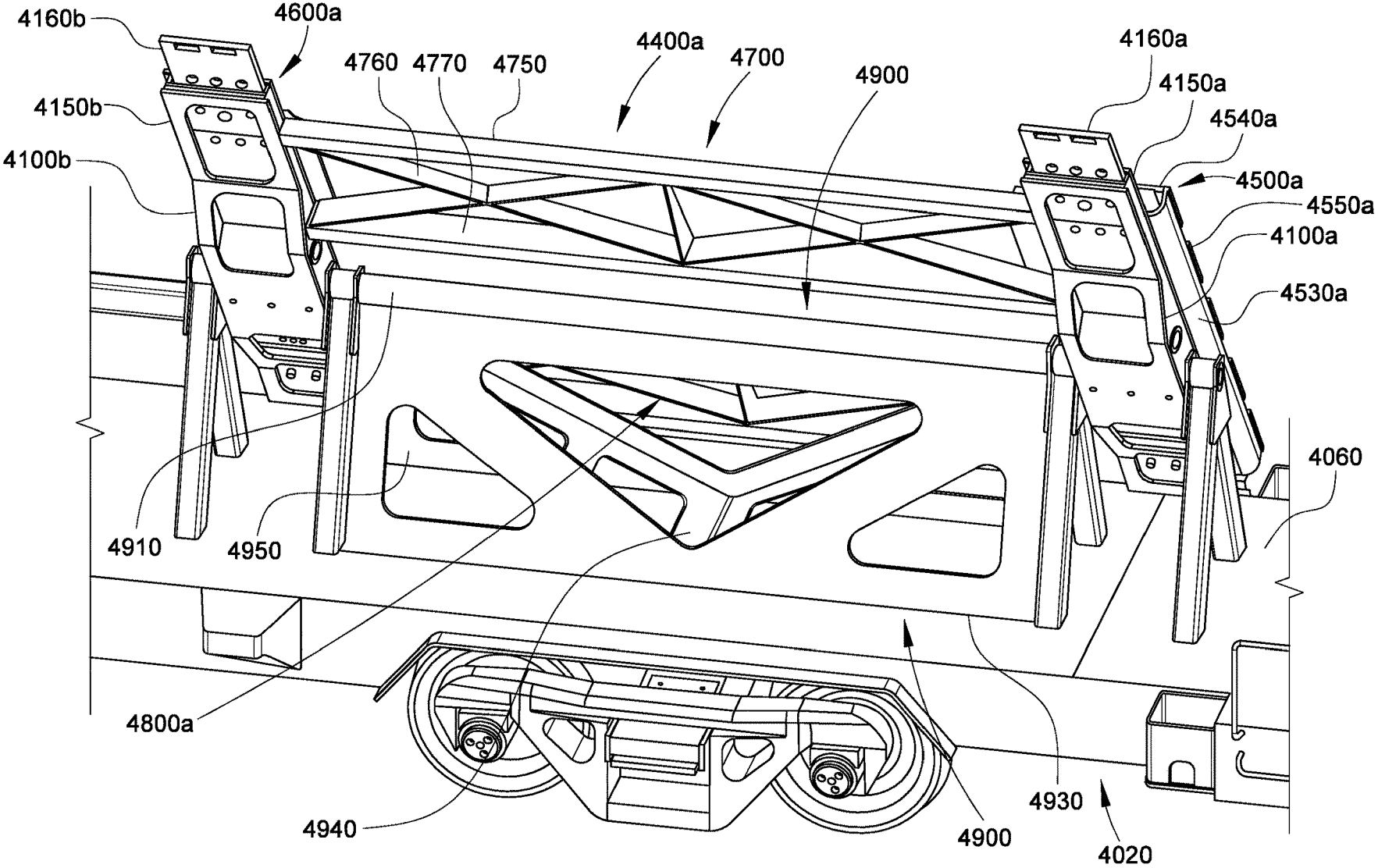
FIG. 19 is a fragmentary second side perspective view of the first end section of the large plate tilt railroad car of FIG. 18.
Figure 20:
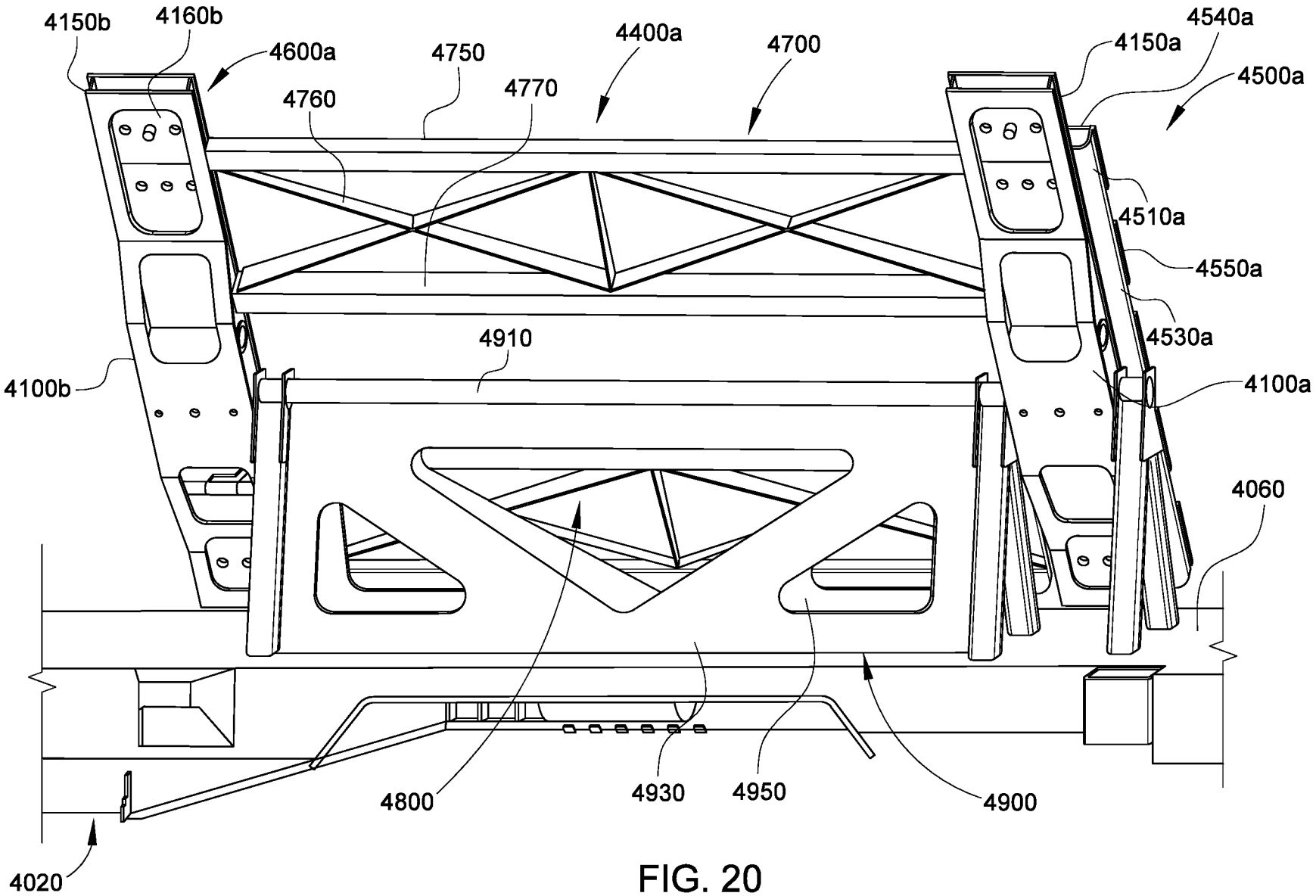
FIG. 20 is a fragmentary second side perspective view of the first end section of the large plate tilt railroad car of FIG. 18.
Figure 21:
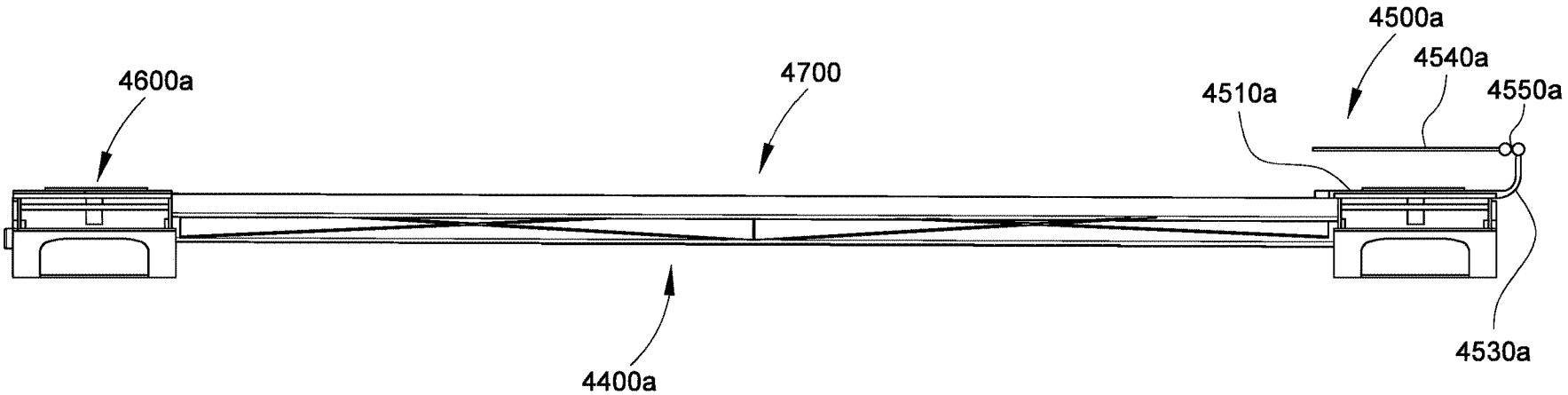
FIG. 21 is a top view of part of the plate movement blocker of the first end section of the large plate tilt railroad car of FIG. 18, showing the gate thereof in a closed position.

The first plate blocker 4500*a* is connected to the first plate holder 4150*a* of the first plate supporter 4100*a* of the plate support assembly (not labeled) of the railroad car 4020. In this example embodiment, the first plate holder 4150*a* includes an upper extension member 4160*a* that is moveable to different heights as shown in FIGS. 18, 19, and 20.

Figure 22:
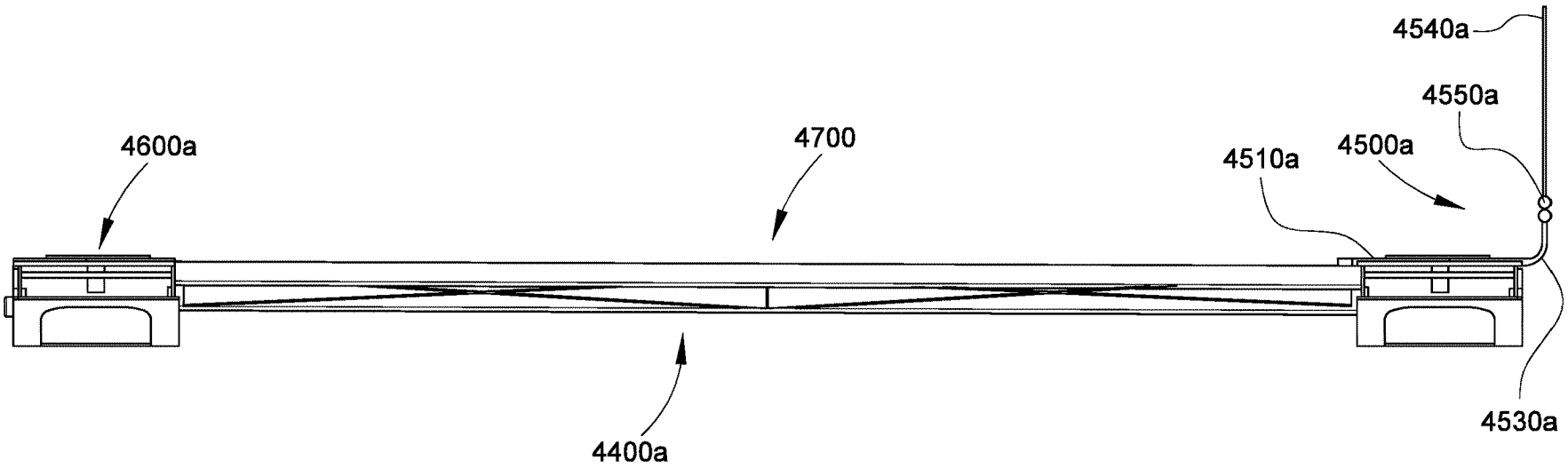
FIG. 22 is a top view of part of the plate movement blocker of the first end section of the large plate tilt railroad car of FIG. 18, showing the gate thereof in an open position.
Figure 23:
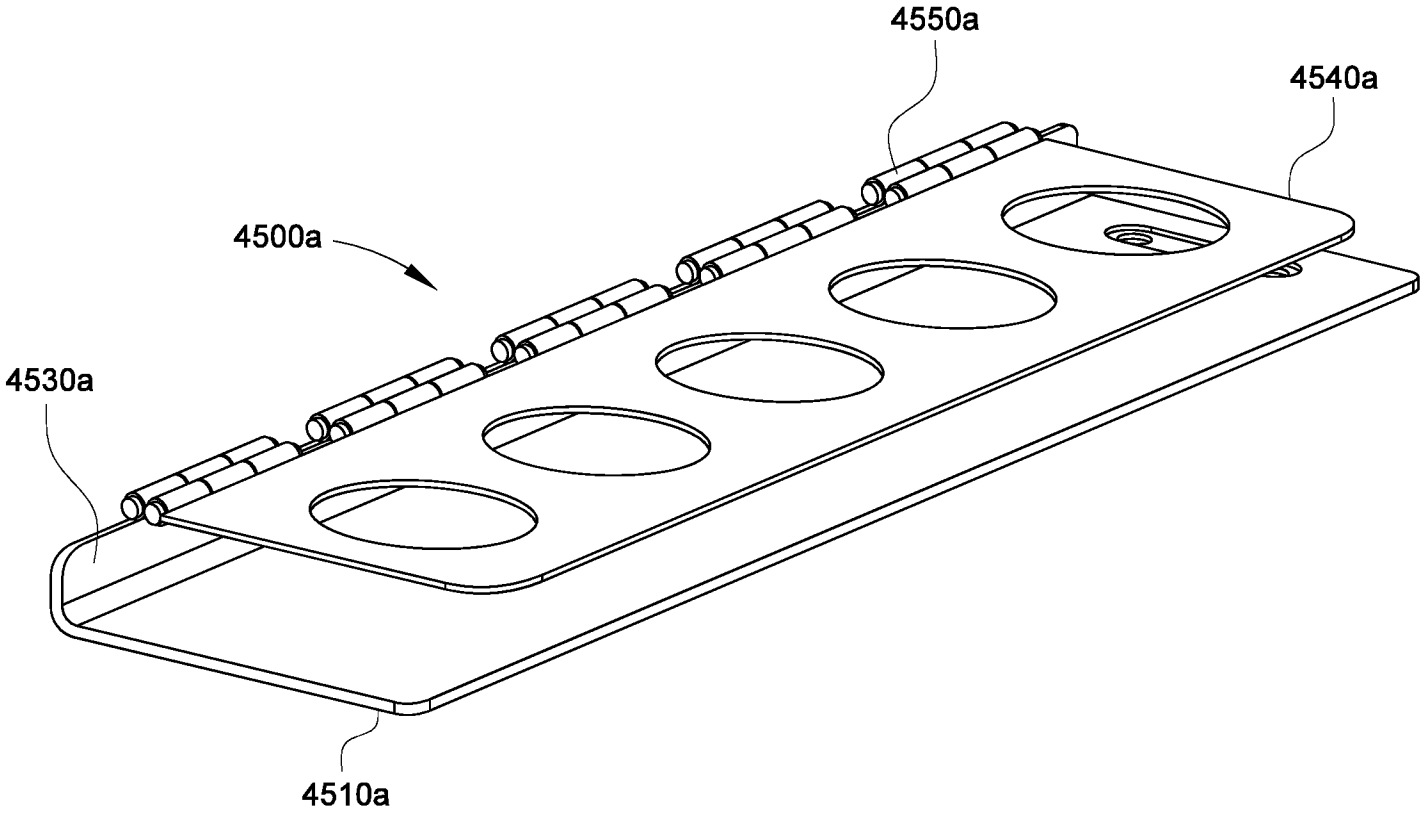
FIG. 23 is an enlarged perspective view of the plate blocker of the plate movement blocker of the first end section of the large plate tilt railroad car of FIG. 18, showing the gate thereof in a closed position.
Figure 24:
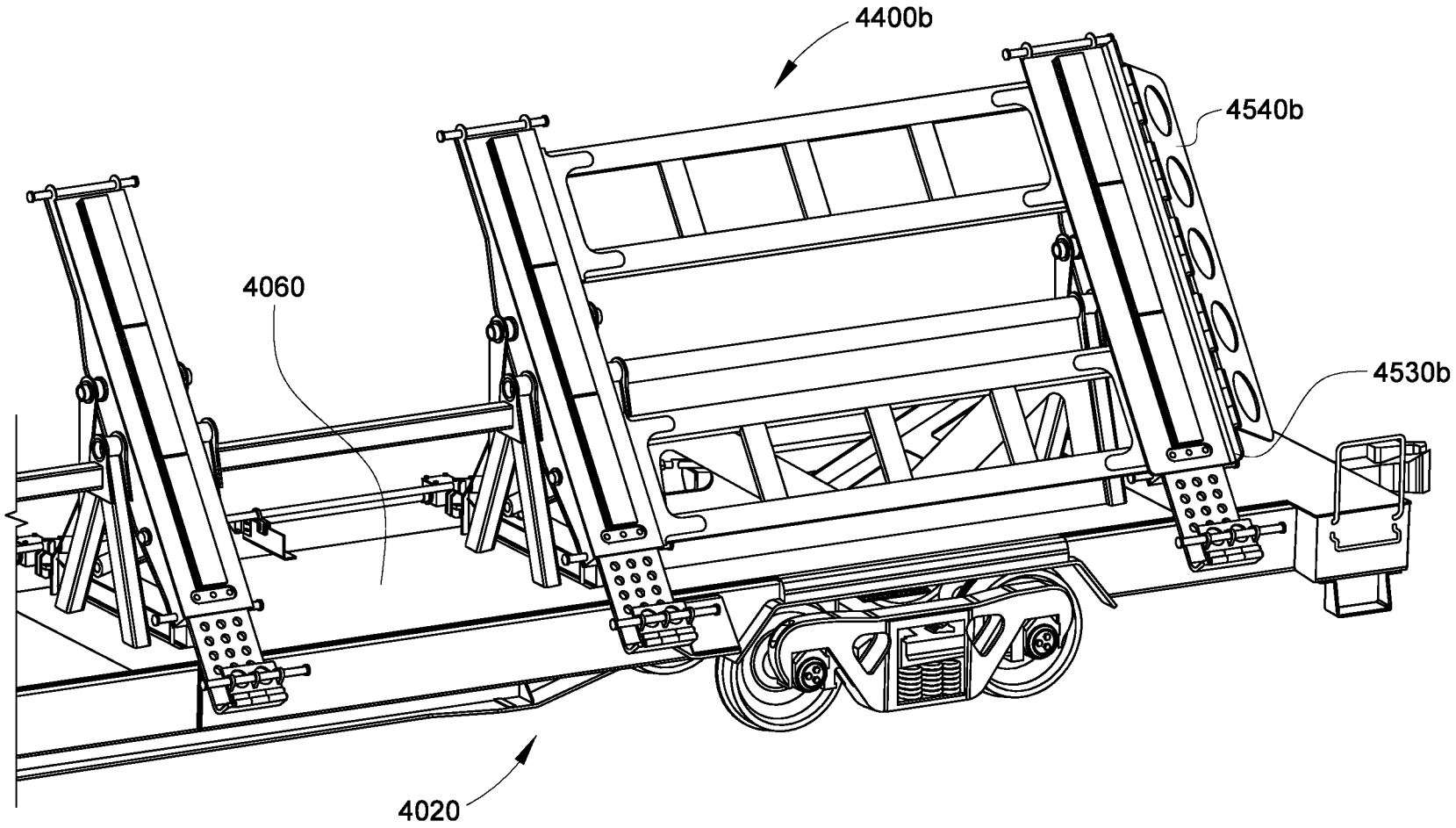
FIG. 24 is fragmentary side perspective view of a second end section of the unloaded large plate tilt railroad car of FIG. 18, showing the gate of the plate blocker of the plate movement blocker thereof in an open position.
Figure 25:
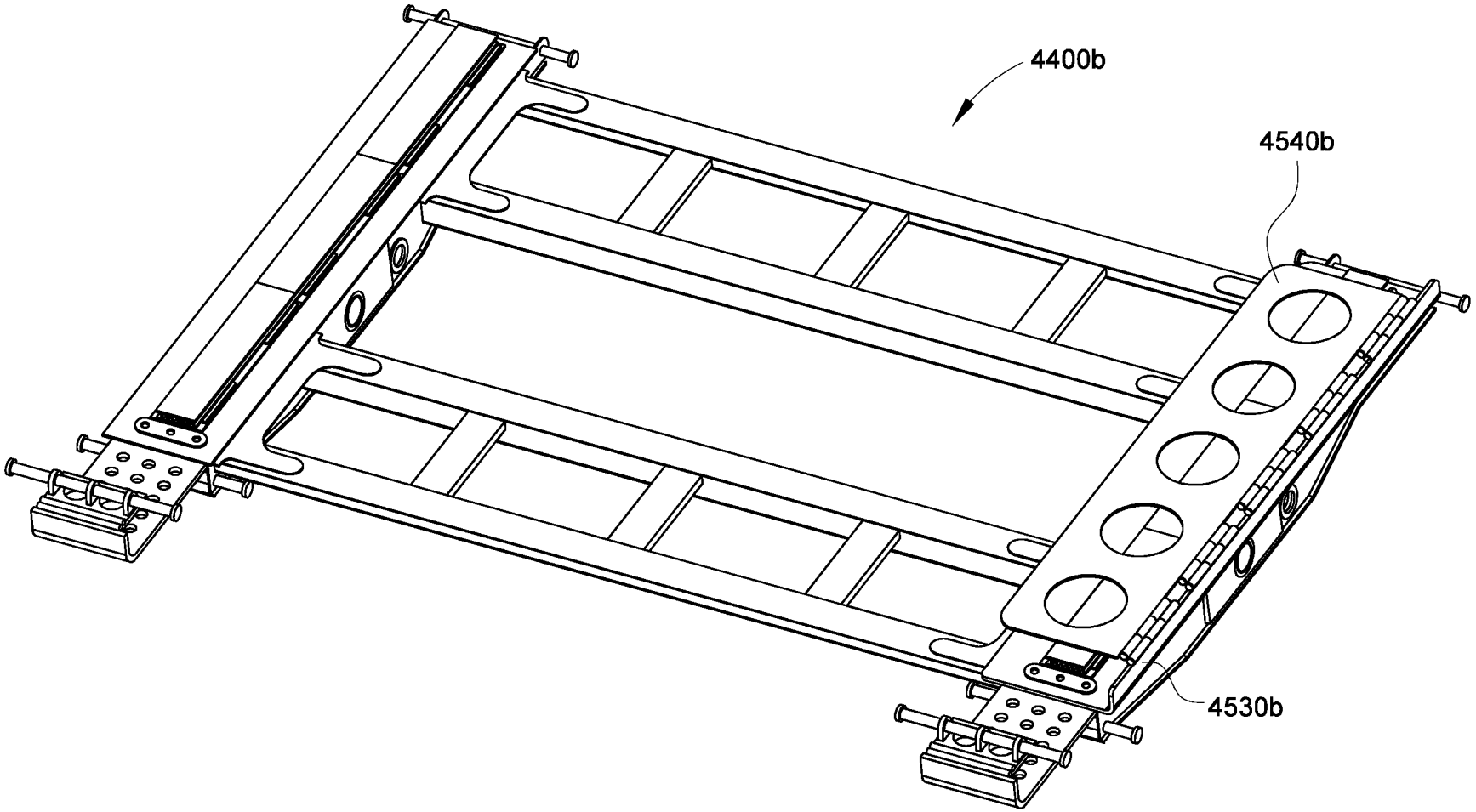
FIG. 25 is perspective view of the plate movement blocker of the second end section of the unloaded large plate tilt railroad car of FIG. 18, showing the gate thereof in a closed position.

The first plate blocker 4500*a* includes a base 4510*a* connected to the first plate holder 4150*a*, a first bulkhead 4530*a* connected to and extending outwardly from the base 4510*a*, and a gate 4540*a* pivotally connected to the first bulkhead 4530*a* by a hinge assembly 4550*a*. The first bulkhead 4530*a* is configured to be engaged by an end of the steel plate (not shown) and is thus configured to prevent longitudinal movement or substantial longitudinal movement of the steel plate. The gate 4540*a* is configured to pivot about the hinge assembly 4550*a* from a closed position (as shown in FIGS. 18, 19, 20, and 21) to an open position (as shown in FIG. 22). The gate 4540*a* is manually moveable in this example embodiment. The present disclosure contemplates that the gate 4540*a* can be alternatively moveable by a suitable actuator. When the gate 4540*a* is in the open position, the gate 4540*a* enables the steel plate 25 to be positioned on the base 4510*a* and the first plate holder 4150*a*. When the gate 4540*a* is in the open position, the gate 4540*a* also enables the steel plate 25 to removed from being positioned on the base 4510*a* and the first plate holder 4150*a*. When the gate 4540*a* is in the closed position, the gate 4540*a* prevents the steel plate from moving transversely or substantially transversely. It should be appreciated that the respective gates at both ends of the railroad car 4020 will co-act to perform these functions.

The anchor 4600*a* is connected to the second plate holder 4150*b* of the second plate supporter 4100*b* of the plate support assembly (not labeled) of the railroad car 4020. In this example embodiment, the second plate holder 4150*b* includes an upper extension member 4160*b* that is moveable to different heights as shown in FIGS. 18, 19, and 20. The anchor 4600*a* includes a base 4610*a* connected to the second plate supporter 4150*b* of the plate support assembly (not labeled) of the railroad car 4020.

The first load transfer assembly 4700 includes a load transfer frame 4710 having a first end connector plate 4720 connecting a first end of the frame 4710 to the first load plate holder 4150*a* and a second end connector plate 4730 connecting a second end of the frame 4710*a* to the second plate holder 4150*b*. The frame 4710 includes an upper member 4750, a lower member 4770, and a plurality of cross members 4760 connected to and connecting the upper member 4750 and the lower member 4770. The frame 4710 can be otherwise suitably positioned, shaped, sized, and otherwise configured in accordance with the present disclosure.

Likewise, the second load transfer assembly 4800 includes a load transfer frame 4810 having a first end connector plate 4820 connecting a first end of the frame 4810 to the first load plate holder 4150*a* and a second end connector plate 4830 connecting a second end of the frame 4810 to the second plate holder 4150*b*. The frame 4810 includes an upper member 4850, a lower member 4870, and a plurality of cross members 4860 connected to and connecting the upper member 4850 and the lower member 4870. The frame 4810 can be otherwise suitably positioned, shaped, sized, and otherwise configured in accordance with the present disclosure.

The first and second load transfer assemblies 4700 and 4800 are configured to co-act to transfer forces incurred by the steel plate 25 engaging the plate blocker 4500*a* (and particularly the bulkhead 4530*a*) to the anchor 4600*a*.

The anchor 4600*a* is configured to transfer these forces received from the first and second load transfer assemblies 4700 and 4800 to the third load transfer assembly 4900.

In this illustrated example embodiment, the third load transfer assembly 4900 has a somewhat tent like or A-frame like structure although the structure can vary in accordance with the present disclosure.

More specifically, the third load transfer assembly 4900 includes a head 4910, a first leg 4930, a second leg 4950, and a leg connector 4400. The head 4910 is connected to an upper end of the first leg 4930 and to an upper end of the second leg 4950.

The head 4910 includes a cylindrical tube in this example embodiment, but can be otherwise suitably formed. The head 4910 is connected at a first end to the first plate supporter 4100*a* and at a second end to the second plate supporter 4100*b*.

The first leg 4930 is connected to the head 4910 and extends downwardly from the head 4910 to the deck 4060, and is fixedly connected to the deck 4060. The first leg 4930 is in the form of a plate in this example embodiment, but can be otherwise suitably configured. The first leg 4930 is suitably configured to transfer forces from the anchor 4600*a* to the deck 4060.

The second leg 4950 is connected to the head 4910 and extends downwardly to from the head 4910 to the deck 4060, and is fixedly connected to the deck 4060. The second leg 4950 is also in the form of a plate in this example embodiment, but can be otherwise suitably configured. The second leg 4950 is suitably configured to transfer forces from the anchor 4600*a* to the deck 4060.

The leg connector 4940 is fixedly connected to the first and second legs 4930 and 4950, extends between the first and second legs 4930 and 4950, extends downwardly to the deck 4060, and is fixedly connected to the deck 4060. The leg 4950 is also suitably configured to transfer forces from the anchor 4600*a* to the deck 4060.

The third load transfer assembly 4900 is thus configured to transfer forces from the anchor 4600*a* to the deck 4060.

It should be appreciated from the above, that in various embodiments the present disclosure provide a railroad car that can transport large plates without pneumatically powered or hydraulically powered plate movement systems.

It will be understood that modifications and variations may be affected without departing from the scope of the novel concepts of the present invention, and it is understood that this application is to be limited only by the scope of the claims.

The claims are follows:

1. A large plate tilt railroad car comprising:

a frame;

a deck connected to the frame;

a plate support assembly connected to the deck, the plate support assembly including a plurality of spaced-apart pivotable plate supporters including a first plate supporter positioned adjacent to a first end of the deck and a last plate supporter positioned adjacent to a second end of the deck; and a first plate blocker supported by the first plate supporter, the first plate blocker connected to a first plate holder of the first plate supporter, the first plate blocker including a base connected to the first plate holder, a first bulkhead connected to and extending outwardly from the base, and a gate connected to the first bulkhead, wherein the first bulkhead is configured to be engaged by an end of a steel plate supported by the plate support assembly to prevent substantial longitudinal movement of the steel plate.

2. The railroad car of claim 1, wherein the gate is pivotally connected to the first bulkhead by a hinge assembly, wherein the gate is pivotable about the hinge assembly from a closed position to an open position.

3. The railroad car of claim 1, wherein the first plate blocker is part of a first plate movement blocker that includes an anchor connected to a second plate supporter of the plurality of plate supporters.

4. The railroad car of claim 3, wherein the first plate movement blocker includes a first load transfer assembly configured to transfer forces incurred by the steel plate engaging the bulkhead of the first plate blocker to the anchor.

5. The railroad car of claim 4, wherein the first plate movement blocker includes a second load transfer assembly configured to transfer forces incurred by the steel plate engaging the bulkhead of the first plate blocker to the anchor.

6. The railroad car of claim 5, wherein the first plate movement blocker includes a third load transfer assembly configured to transfer forces on the anchor to the deck.

7. The railroad car of claim 4, wherein the first plate movement blocker includes a third load transfer assembly configured to transfer forces on the anchor to the deck.

8. The railroad car of claim 1, which includes a second plate blocker supported by the last plate supporter.

9. The railroad car of claim 8, wherein the first plate blocker is configured to be engaged by a first end of the steel plate supported by the plate support assembly to prevent substantial longitudinal movement of the steel plate in a first direction, and wherein the second plate blocker is configured to be engaged by a second end of the steel plate supported by the plate support assembly to prevent substantial longitudinal movement of the steel plate in a second direction that is opposite the first direction.

10. The railroad car of claim 8, wherein the second plate blocker includes a second base and a second bulkhead connected to and extending outwardly from the second base, wherein the second bulkhead is configured to be engaged by a second end of the steel plate supported by the plate support assembly to prevent substantial longitudinal movement of the steel plate in a second direction that is opposite the first direction.

11. The railroad car of claim 8, wherein the second plate blocker includes a second gate.

12. The railroad car of claim 11, wherein the first gate and the second gate are pivotal toward each other to respective closed positions and are pivotal away from each other to respective open positions.

13. The railroad car of claim 8, wherein the first plate blocker is part of a first plate movement blocker, and the second plate blocker is part of a second plate movement blocker.

14. The railroad car of claim 13, wherein the first plate movement blocker includes at least one load transfer assembly configured to transfer forces incurred by the steel plate engaging the first plate blocker to the deck, and wherein the second plate movement blocker includes at least one load transfer assembly configured to transfer forces incurred by the steel plate engaging the second plate blocker to the deck.

15. The railroad car of claim 13, wherein the first plate movement blocker includes a first plurality of different load transfer assemblies configured to transfer forces incurred by the steel plate engaging the first plate blocker to the deck, and wherein the second plate movement blocker includes a second plurality of different load transfer assemblies configured to transfer forces incurred by the steel plate engaging the second plate blocker to the deck.

16. The railroad car of claim 8, wherein the first plate blocker is part of a first plate movement blocker that includes a first anchor connected to a second one of the plate supporters, and the second plate blocker is part of a second plate movement blocker that includes a second anchor connected to a second to last one of the plate supporters.

17. The railroad car of claim 16, wherein the first plate movement blocker includes a first plurality of different load transfer assemblies configured to transfer forces incurred by the steel plate engaging the first plate blocker to the first anchor and to the deck, and wherein the second plate movement blocker includes a second plurality of different load transfer assemblies configured to transfer forces incurred by the steel plate engaging the second plate blocker to the second anchor and the deck.

18. A large plate tilt railroad car comprising:

a frame;

a deck connected to the frame;

a plate support assembly connected to the deck, the plate support assembly including a plurality of spaced-apart pivotable plate supporters including a first plate supporter positioned adjacent to a first end of the deck and a last plate supporter positioned adjacent to a second end of the deck; and a first plate blocker supported by the first plate supporter, the first plate blocker including a gate configured to be engaged by part of a steel plate supported by the plate support assembly to prevent substantial transverse movement of the steel plate.

19. The railroad car of claim 18, wherein the gate is pivotable about a hinge assembly from a closed position to an open position.

20. The railroad car of claim 19, wherein the second gate is pivotable about a second hinge assembly from a closed position to an open position.

21. The railroad car of claim 18, which includes a second plate blocker supported by the last plate supporter.

22. The railroad car of claim 21, wherein the first gate and the second gate are pivotal toward each other to respective closed positions and are pivotal away from each other to respective open positions.

23. The railroad car of claim 18, wherein the second plate blocker includes a second gate.

* * * * *